US011043120B2

(12) United States Patent
Umehara

(10) Patent No.: US 11,043,120 B2
(45) Date of Patent: Jun. 22, 2021

(54) PREFERENTIAL CONTROL CANCEL DEVICE, CANCEL METHOD, AND COMPUTER PROGRAM

(71) Applicant: SUMITOMO ELECTRIC INDUSTRIES, LTD., Osaka (JP)

(72) Inventor: Shigeki Umehara, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/624,108

(22) PCT Filed: Jun. 28, 2017

(86) PCT No.: PCT/JP2017/023746
§ 371 (c)(1),
(2) Date: Dec. 18, 2019

(87) PCT Pub. No.: WO2019/003341
PCT Pub. Date: Jan. 3, 2019

(65) Prior Publication Data

US 2020/0211378 A1 Jul. 2, 2020

(51) Int. Cl.
*G09G 1/07* (2006.01)
*G08G 1/07* (2006.01)
*G08G 1/01* (2006.01)

(52) U.S. Cl.
CPC ..... *G08G 1/07* (2013.01); *G08G 1/01* (2013.01)

(58) Field of Classification Search
CPC ..... G08G 1/07; G08G 1/01
USPC ..... 340/917
See application file for complete search history.

(56) References Cited

U.S. PATENT DOCUMENTS 3,602,880 A * 8/1971 Ueda ..... G08G 1/08 340/920
4,907,160 A * 3/1990 Duncan ..... G08G 1/081 340/907
5,257,194 A * 10/1993 Sakita ..... G08G 1/081 340/911

(Continued)

FOREIGN PATENT DOCUMENTS

JP S50-104596 A 8/1975
JP S51-145299 A 12/1976

(Continued)

OTHER PUBLICATIONS

"Manual on Traffic Signal Control Revised Eidtion," p. 76, published in Jul. 2006, edited and published by Japan Society of Traffic Engineers.

(Continued)

*Primary Examiner* — Kerri L McNally
*Assistant Examiner* — Thang D Tran
(74) *Attorney, Agent, or Firm* — Faegre Drinker Biddle & Reath LLP

(57) ABSTRACT

A preferential control cancel unit includes: a determination unit configured to determine whether or not a vehicle approaching an intersection is an execution target of preferential control for preferential passage through the intersection; and a control unit configured to cause execution of the preferential control to be canceled in a case where the vehicle is determined to be the execution target and a predetermined condition is satisfied.

7 Claims, 17 Drawing Sheets

(56) References Cited

U.S. PATENT DOCUMENTS 5,296,113 A * 3/1994 Luniewski ..... B01F 13/0001 204/157.15
8,862,372 B2 * 10/2014 Li ..... G01C 21/26 701/117
9,460,613 B1 * 10/2016 Whiting ..... G06K 9/00785
2002/0059017 A1 * 5/2002 Yamane ..... G08G 1/08 701/1
2003/0210156 A1 * 11/2003 Nishimura ..... G08G 1/08 340/907
2007/0260392 A1 * 11/2007 Paolini ..... G08G 1/07 701/117
2008/0024323 A1 * 1/2008 Kadaba ..... G01N 33/0075 340/905
2010/0004839 A1 * 1/2010 Yokoyama ..... G08G 1/052 701/70
2010/0079306 A1 * 4/2010 Liu ..... G08G 1/0104 340/909
2010/0145600 A1 * 6/2010 Son ..... G08G 1/096716 701/123
2010/0171640 A1 * 7/2010 Delia ..... G08G 1/07 340/907
2010/0191449 A1 * 7/2010 Iwamoto ..... G08G 1/08 701/118
2011/0029281 A1 * 2/2011 Tsukamoto ..... G01C 21/3492 702/176
2012/0112928 A1 * 5/2012 Nishimura ..... G08G 1/07 340/909
2012/0136570 A1 * 5/2012 Yamashita ..... G08G 1/0137 701/437
2012/0143395 A1 * 6/2012 Yamada ..... G08G 1/096783 701/1
2012/0146811 A1 * 6/2012 Chou ..... G08G 1/096783 340/905
2013/0151135 A1 * 6/2013 Aubrey ..... G08G 1/0116 701/118
2013/0162449 A1 * 6/2013 Ginsberg ..... G08G 1/081 340/910
2013/0245945 A1 * 9/2013 Morita ..... G08G 1/096716 701/533
2013/0338852 A1 * 12/2013 Otake ..... G08G 1/09626 701/1
2014/0149029 A1 * 5/2014 Sakakibara ..... G08G 1/0133 701/118
2014/0368358 A1 * 12/2014 Xie ..... G08G 1/08 340/922
2015/0066271 A1 * 3/2015 Ogawa ..... G01C 21/36 701/22
2015/0279215 A1 * 10/2015 Shibata ..... G08G 1/166 340/435
2016/0042641 A1 * 2/2016 Smith ..... G08G 1/0133 340/917
2016/0097849 A1 * 4/2016 Nichols ..... G08G 1/096716 342/107
2016/0203717 A1 * 7/2016 Ginsberg ..... G08G 1/096775 701/117
2016/0229409 A1 * 8/2016 Pascheka ..... B60W 50/0097
2017/0053529 A1 * 2/2017 Yokoyama ..... G08G 1/0145
2017/0069200 A1 * 3/2017 Masutani ..... H04L 67/42
2017/0124863 A1 * 5/2017 Dumazert ..... G08G 1/0133
2017/0178508 A1 * 6/2017 Chiu ..... G08G 1/096775
2018/0122227 A1 * 5/2018 Mubarek ..... G08B 21/18
2018/0151064 A1 * 5/2018 Xu ..... G08G 1/0116
2018/0158326 A1 * 6/2018 Fowe ..... G08G 1/0133
2018/0286228 A1 * 10/2018 Xu ..... G08G 1/0112
2019/0096248 A1 * 3/2019 Liu ..... G08G 1/096783

FOREIGN PATENT DOCUMENTS

JP H10-111999 A 4/1998
JP 2001-184592 A 7/2001
JP 2001-202594 A 7/2001
JP 2011-60019 A 3/2011
JP 2013-214225 A 10/2013
JP 2013214225 * 10/2013 ..... G08G 1/09
JP 2015166974 * 9/2015 ..... G08G 1/09

OTHER PUBLICATIONS

Head, Larry, "The Multi Modal Intelligent Traffic Signal System (MMITSS)," Transportation Research Board 94th Annual Meeting, Jan. 11, 2015, P15-6604, p. 12.

* cited by examiner

PREFERENTIAL CONTROL CANCEL DEVICE, CANCEL METHOD, AND COMPUTER PROGRAM

TECHNICAL FIELD

The present invention relates to a preferential control cancel device, a preferential control cancel method, and a computer program.

BACKGROUND ART

In urban areas, a public transportation system (PTPS) is sometimes adopted for preferential passage of public vehicles such as fixed-route buses (refer to Non-Patent Literature 1 for example).

In this system, preferential control of a traffic signal, for example, controlling a traffic signal to allow preferential passage of a public vehicle through an intersection, is performed. Specifically, when a public vehicle is approaching an intersection, if green light of a traffic signal at the intersection almost ends, the green interval is extended. If the traffic signal at the intersection shows red light, the red interval is shortened for quick change to green light.

Examples of systems for preferential control of traffic signals include FAST (Fast Emergency Vehicle Preemption Systems) and FSP (Freight Signal Priority).

Further, Non-Patent Literature 2 discloses a system that performs preferential control of traffic signals based on requests from vehicles.

CITATION LIST

Non Patent Literature

NON PATENT LITERATURE 1: "Manual on Traffic Signal Control Revised Edition", p. 76, published in July, 2006, edited and published by Japan Society of Traffic Engineers NON PATENT LITERATURE 2: Larry Head, "The Multi Modal Intelligent Traffic Signal System (MMITSS), Transportation Research Board 94th Annual Meeting, Jan. 11, 2015, P15-6604, p. 12

SUMMARY OF INVENTION

Solution to Problem

A preferential control cancel device according to one embodiment includes: a determination unit configured to determine whether or not a vehicle approaching an intersection is an execution target of preferential control for preferential passage through the intersection; and a control unit configured to cause execution of the preferential control to be canceled in a case where the vehicle is determined to be the execution target and a predetermined condition is satisfied.

A cancel method according to another embodiment is a cancel method for cancelling preferential control, for preferential passage through an intersection, which is executed for a vehicle approaching the intersection. The method includes: determining whether or not the vehicle is an execution target of the preferential control; and causing execution of the preferential control to be canceled in a case where the vehicle is determined to be the execution target and a predetermined condition is satisfied.

A computer program according to still another embodiment is configured to cause a computer to execute a process of canceling preferential control, for preferential passage through an intersection, which is executed for a vehicle approaching the intersection. This program causes the computer to execute: determining whether or not the vehicle is an execution target of the preferential control; and causing execution of the preferential control to be canceled in a case where the vehicle is determined to be the execution target and a predetermined condition is satisfied.

DESCRIPTION OF EMBODIMENTS

Description of Embodiments

Figure 1:
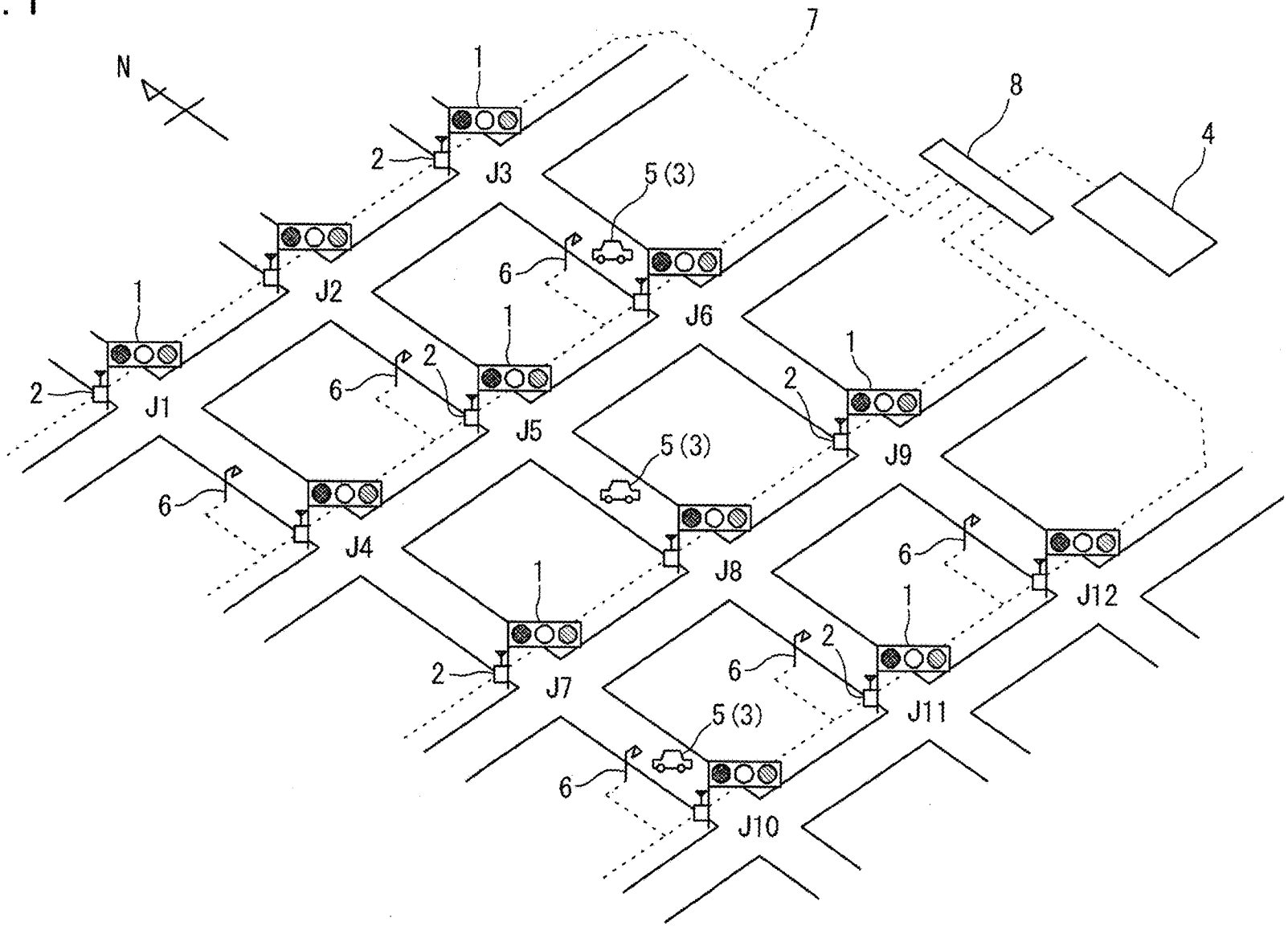
FIG. 1 is a perspective view schematically showing an overall configuration of an intelligent transport system according to an embodiment.

First, the contents of embodiments of the present invention are listed and described.

(1) A preferential control cancel device according to one embodiment includes: a determination unit configured to determine whether or not a vehicle approaching an intersection is an execution target of preferential control for preferential passage through the intersection; and a control unit configured to cause execution of the preferential control to be canceled in a case where the vehicle is determined to be the execution target and a predetermined condition is satisfied.

According to the above configuration, after the vehicle has been determined to be the execution target, if a predetermined condition, such that the vehicle cannot pass through the intersection before the preferential control ends, is satisfied, execution of the preferential control can be canceled. Therefore, the preferential control is inhibited from being unnecessarily executed.

(2) In the above-described preferential control cancel device, if the vehicle cannot pass through the intersection before the preferential control ends, the preferential control is wasted.

Therefore, preferably, the predetermined condition is that the control unit determines that the vehicle cannot pass through the intersection before the preferential control ends.

In this case, if the control unit determines that the vehicle cannot pass through the intersection before the preferential control ends, execution of the preferential control can be canceled.

(3) In the above-described preferential control cancel device, if exit-blocking jam has occurred in the advancing direction of the vehicle in the intersection, the vehicle may not be able to pass through the intersection.

Therefore, preferably, the predetermined condition is that the control unit determines that exit-blocking jam has occurred on an outflow road, from the intersection, to be a target of the preferential control for the vehicle.

In this case, if exit-blocking jam has occurred on the outflow road from the intersection, execution of the preferential control can be canceled.

(4) In the preferential control cancel device, if there is a contradiction between the content of the preferential control for the vehicle and the actual advancing direction of the vehicle, the preferential control for the vehicle need not be executed.

Therefore, preferably, the predetermined condition is that the control unit determines that there is a contradiction between the content of the preferential control for the vehicle and the advancing direction, of the vehicle in the intersection, which is based on probe information of the vehicle.

In this case, if the control unit determines that there is a contradiction between the content of the preferential control for the vehicle and the advancing direction, of the vehicle in the intersection, which is based on probe information of the vehicle, execution of the preferential control can be canceled.

(5) In the preferential control cancel device, if reliability of the probe information acquired from the vehicle is low, reliability of preferential control to be executed based on the probe information is also reduced.

Therefore, preferably, the predetermined condition is that the control unit determines that the reliability of the probe information of the vehicle is lower than a predetermined threshold.

In this case, if the control unit determines that the reliability of the probe information of the vehicle is lower than the predetermined threshold, execution of the preferential control can be canceled.

(6) A cancel method according to another embodiment is a cancel method for cancelling preferential control, for preferential passage through an intersection, which is executed for a vehicle approaching the intersection. The method includes: determining whether or not the vehicle is an execution target of the preferential control; and causing execution of the preferential control to be canceled in a case where the vehicle is determined to be the execution target and a predetermined condition is satisfied.

(7) A computer program according to still another embodiment is configured to cause a computer to execute a process of canceling preferential control, for preferential passage through an intersection, which is executed for a vehicle approaching the intersection. This program causes the computer to execute: determining whether or not the vehicle is an execution target of the preferential control; and causing execution of the preferential control to be canceled in a case where the vehicle is determined to be the execution target and a predetermined condition is satisfied.

Problems to be Solved by the Disclosure

For example, when the above-described preferential control is applied to a general vehicle as well as a public vehicle, it is conceivable that the vehicle is caused to transmit a message for requesting preferential control, and a control device for executing preferential control is caused to execute preferential control based on the message, or the control device is caused to detect a target vehicle to be subjected to preferential control, and execute preferential control for the target vehicle.

However, even when the control device has started preferential control, if the target vehicle will not cross a stop line of a traffic signal because the vehicle is stopped or turned right or left on the upstream side of the traffic signal, extension of the green interval or shortening of the red interval may be unnecessarily executed.

The unnecessary extension of the green interval or shortening of the red interval causes an increase in delay time for vehicles traveling other lanes, which may result in an increase in delay time throughout the intersection.

The present disclosure has been made in view of the above situations, and an object of the present disclosure is to provide a technology capable of inhibiting unnecessary execution of preferential control.

Advantageous Effects of the Present Disclosure

According to the present disclosure, preferential control is inhibited from being unnecessarily executed.

Details of Embodiments

Hereinafter, preferred embodiments will be described in detail with reference to the drawings. At least some parts of the embodiments described below may be combined together as desired.

[Overall Configuration of System]

FIG. 1 is a perspective view schematically showing the overall configuration of an intelligent transport system (ITS) according to an embodiment. In this embodiment, as an example of a road structure, a grid-pattern structure in which a plurality of roads in a north-to-south direction and a plurality of roads in an east-to-west direction intersect with each other, is assumed.

As shown in FIG. 1, the intelligent transport system of the present embodiment includes: traffic signal units 1; traffic signal controllers 10; roadside communication devices 2; on-vehicle communication devices (mobile communication devices) 3; a central apparatus 4; vehicles 5 each equipped with an on-vehicle communication device 3; and roadside sensors 6 each including a vehicle detector, a monitor camera or the like.

A traffic signal unit 1 and a roadside communication device 2 are installed at each of a plurality of intersections J1 to J12, and are connected to a router 8 via a cable communication line 7 such as a telephone line. This router 8 is connected to the central apparatus 4 in a traffic control center.

The central apparatus 4 establishes a LAN (Local Area Network) with the traffic signal units 1 and the roadside communication devices 2 in an area that the central apparatus 4 covers. Therefore, bidirectional communication can be performed between the central apparatus 4 and each roadside communication device 2.

The roadside sensors 6 are installed at various points on roads within an management area that the central apparatus 4 covers, for the purpose of, for example, counting the number of vehicles that enter or exit each intersection.

Each roadside sensor 6 is composed of, for example, a vehicle detector that detects a vehicle 5 traveling directly below the vehicle detector by means of an ultrasonic wave or the like, or a monitor camera or the like that time-sequentially photographs the traffic state of the road. The roadside sensor 6 transmits sensor information, such as a pulse signal detected by the vehicle detector or image data to the central apparatus 4 via the communication line 7.

The central apparatus 4 calculates traffic indices such as inflow traffic volumes at intersections Ji by using various types of information collected from the roadside sensors 6 and the like. Based on the calculated traffic indices, the central apparatus 4 performs traffic actuated control (central actuated control) for the intersections Ji that belong to the management area thereof.

Examples of the traffic actuated control performed by the central apparatus 4 include "coordinated control" for controlling a group of traffic signal units 1 at intersections Ji that belong to a predetermined coordinated section, and "wide-area control (area traffic control)" in which the coordinated control is expanded onto a road network.

Upon starting the traffic actuated control, the central apparatus 4 generates traffic signal control parameters including cycle, split, offset, etc., and transmits the generated traffic signal control parameters to a traffic signal unit 1 at an intersection Ji to be subjected to the traffic actuated control, via the roadside communication device 2.

Upon receiving the traffic signal control parameters, the traffic signal unit 1 performs light color control according to the traffic signal control parameters.

In the intelligent transport system, the plurality of roadside communication devices 2, which are components of a wireless communication system and are installed at the respective intersections, are able to perform wireless communication (roadside-to-vehicle communication) with on-vehicle communication devices 3 of vehicles traveling around the roadside communication devices 2.

In addition, each roadside communication device 2 is able to perform wireless communication (roadside-to-roadside communication) with other roadside communication devices 2 located within a predetermined reachable range of a transmission wave therefrom.

Likewise, the on-vehicle communication devices 3 which are components of the wireless communication system are able to perform wireless communication (vehicle-to-roadside communication) with the roadside communication devices 2, and are able to perform wireless communication (vehicle-to-vehicle communication) with other on-vehicle communication devices 3.

The roadside-to-roadside communication is communication between roadside communication devices 2, and is performed when one roadside communication device 2 transmits a communication packet to the other roadside communication device 2.

The roadside-to-vehicle communication is communication between a roadside communication device 2 and on-vehicle communication devices 3, and is performed when the roadside communication device 2 broadcasts a communication packet toward the on-vehicle communication devices 3.

The vehicle-to-vehicle communication is communication between on-vehicle communication devices 3, and is performed when each on-vehicle communication device 3 transmits a communication packet through a carrier sensing method.

The vehicle-to-roadside communication is communication performed between an on-vehicle communication device 3 and a roadside communication device 2, and is performed when the on-vehicle communication device 3 transmits a communication packet toward the roadside communication device 2 by the carrier sensing method.

The roadside communication device 2 is able to intercept a communication packet transmitted through vehicle-to-vehicle communication.

The on-vehicle communication devices 3 insert probe information into communication packets and exchange the communication packets through vehicle-to-vehicle communication.

Therefore, the roadside communication devices 2 are able to obtain the probe information.

The probe information is various types of information relating to a vehicle, which are obtained from an on-vehicle communication device 3 of a vehicle actually traveling on a road. The probe information includes, for example, vehicle ID, vehicle position, vehicle speed, vehicle heading, blinker information relating to flickering blinkers, transmission information relating to setting of an automatic transmission, and data such as occurrence times of these pieces of information.

[Configuration Around Intersection]

Figure 2:
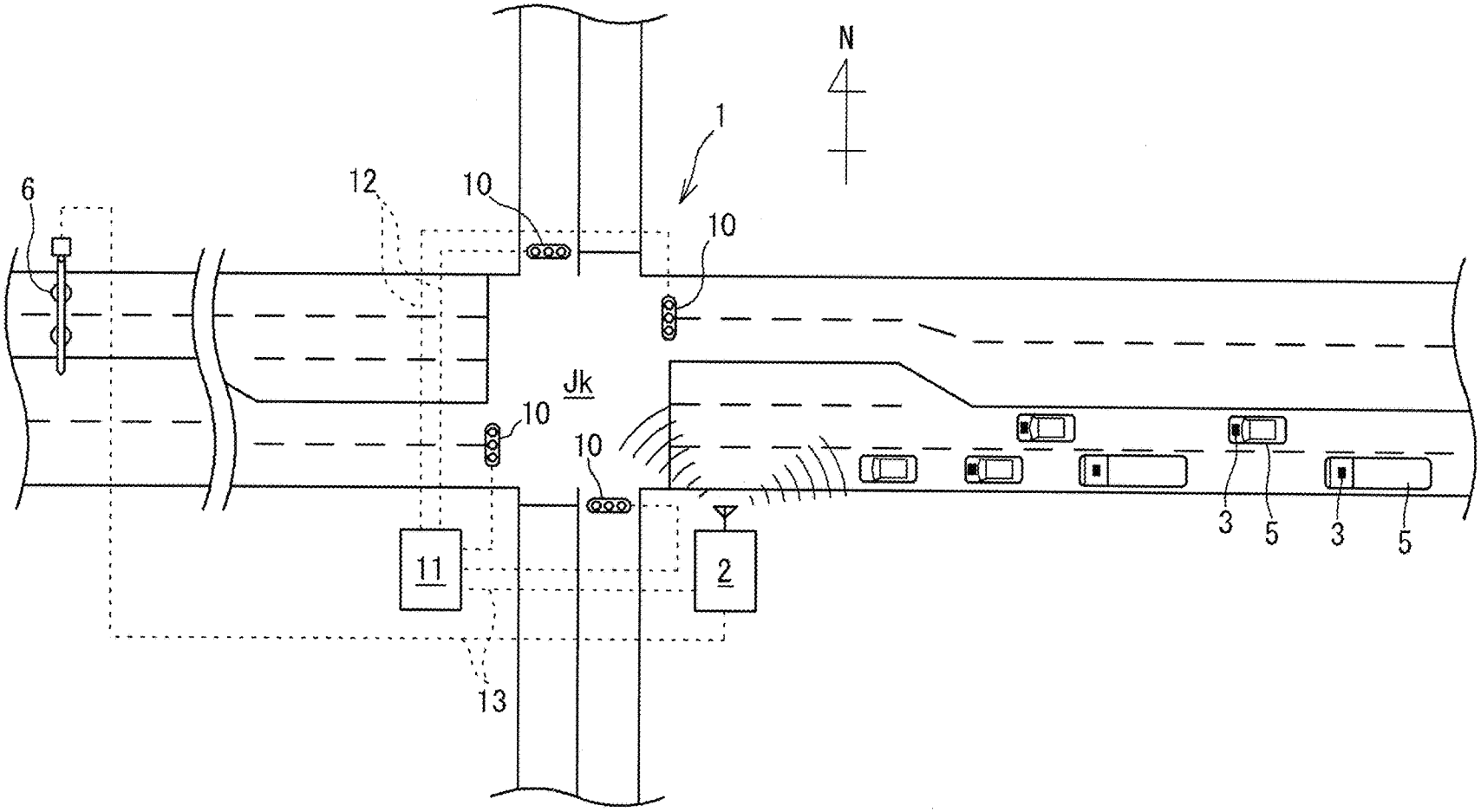
FIG. 2 is a plan view showing an intersection where a roadside communication device is installed.

FIG. 2 is a plan view showing an intersection Jk where a roadside communication device 2 is installed. FIG. 2 shows an example of a road on which vehicles travel on the left side, but the structure shown in FIG. 2 may be applied to a road on which vehicles travel on the right side.

As shown in FIG. 2, a traffic signal unit 1 includes a plurality of traffic signal lights 10 and a traffic signal controller 11. The traffic signal lights 10 are installed on respective paths at the intersection Jk, and display presence/absence of right of way for vehicles 5 that enter the intersection Jk from the paths. The traffic signal lights 10 are connected to the traffic signal controller 11 by signal control lines 12, and timings of turn-on and turn-off of each traffic signal light 10 is controlled by the traffic signal controller 11.

The traffic signal controller 11 is communicably connected to the roadside communication device 2 via a communication line 13.

The traffic signal controller 11 is given the traffic signal control parameters generated by the central apparatus 4 via the roadside communication device 2. The traffic signal controller 11 performs light color control for each traffic signal light 10 on the basis of the traffic signal control parameters.

The roadside communication device 2 relays the traffic signal control parameters obtained from the central apparatus 4 to the traffic signal controller 11. Also, the roadside communication device 2 can broadcast, to surrounding on-vehicle communication devices 3, light color switching timings obtained from the traffic signal control parameters, and traffic information given from the central apparatus 4.

The roadside communication device 2 according to the present embodiment further includes: a function of controlling (preferential control) the traffic signal controller 11 so as to allow an on-vehicle communication device 3 approaching the intersection Jk to preferentially pass through the intersection Jk; and a function of canceling execution of the preferential control. These functions will be described later in detail.

[Internal Configurations of Respective Devices]

Figure 3:
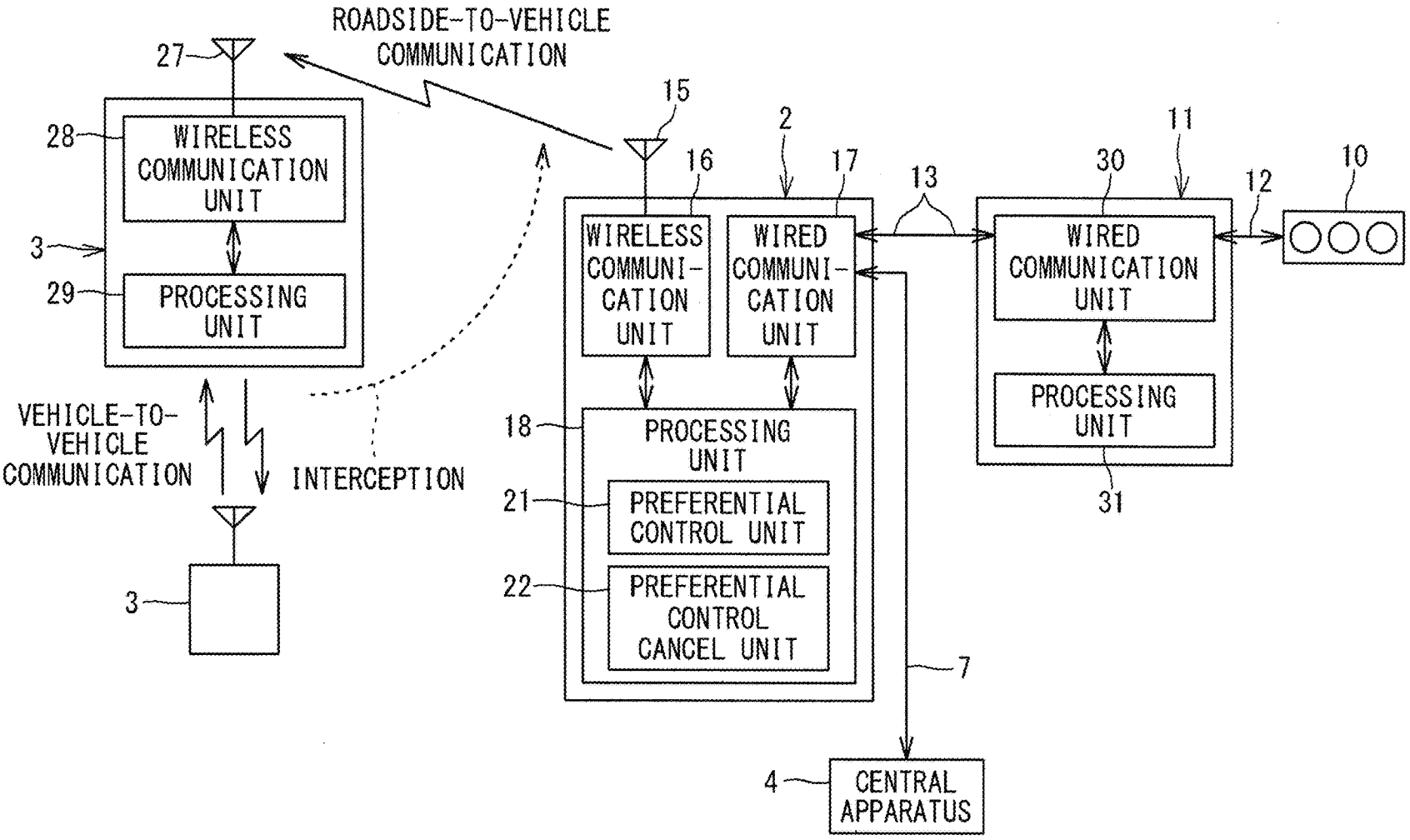
FIG. 3 is a block diagram showing configurations of a roadside communication device, an on-vehicle communication device, a central apparatus, and a traffic signal controller.

FIG. 3 is a block diagram showing the configurations of the roadside communication device 2, the on-vehicle communication device 3, the central apparatus 4, and the traffic signal controller 11 according to the present embodiment.

The on-vehicle communication device 3 is mounted to the vehicle 5 as described above. The on-vehicle communication device 3 has a function of receiving information provided from the roadside communication device 2 and performing processing relating to safe driving support.

The on-vehicle communication device 3 includes: a wireless communication unit 28 to which an antenna 27 for wireless communication is connected; and a processing unit 29.

The processing unit 29 has a function of controlling the wireless communication unit 28 to perform communication such as vehicle-to-vehicle communication or roadside-to-vehicle communication, and exchange data. The processing unit 29 further has a function of performing, for example, processing relating to safe driving support.

The processing unit 29 further has a function of transmitting the probe information of the vehicle 5 through vehicle-to-vehicle communication.

The traffic signal controller 11 includes a wired communication unit 30 for wired communication, and a processing unit 31 performing various processes such as communication control and light color control for the traffic signal light 10.

The wired communication unit 30 is connected to the roadside communication device 2 via the communication line 13, and connected to the traffic signal light 10 via the signal control line 12.

The processing unit 31 has a function of controlling the wired communication unit 30 to perform communication with the roadside communication device 2 via the communication line 13, and exchange data. The processing unit 31 further has a function of transmitting a control signal to the traffic signal light 10 via the signal control line 12.

The processing unit 31 has a function of, upon receiving the traffic signal control parameters, generating a control signal for controlling the traffic signal light 10, and providing the control signal to the traffic signal light 10 so that switching of the light color is performed according to the traffic signal control parameters.

The roadside communication device 2 includes: a wireless communication unit 16 to which an antenna 15 for wireless communication is connected; a wired communication unit 17 for wired communication; and a processing unit 18.

The wired communication unit 17 is connected to the traffic signal controller 11 and the central apparatus 4 via the communication line 13 and the communication line 7, respectively.

The processing unit 18 has a function of controlling the wireless communication unit 16 to perform communication such as vehicle-to-vehicle communication or roadside-to-vehicle communication, and exchange data. In addition, the processing unit 18 has a function of controlling the wired communication unit 17 to perform communication with the traffic signal controller 11 via the communication line 13 and with the central apparatus 4, and exchange data.

Furthermore, the processing unit 18 functionally includes a preferential control unit 21 and a preferential control cancel unit 22.

The preferential control unit 21 has a function of executing preferential control for an on-vehicle communication device 3 that is approaching the intersection Jk. Here, the "preferential control" is a process of controlling the traffic signal controller 11 so as to allow the on-vehicle communication device 3 approaching the intersection Jk to preferentially pass through the intersection Jk. The preferential control will be described later.

The preferential control cancel unit 22 has a function of canceling the preferential control being executed by the preferential control unit 21.

Figure 4:
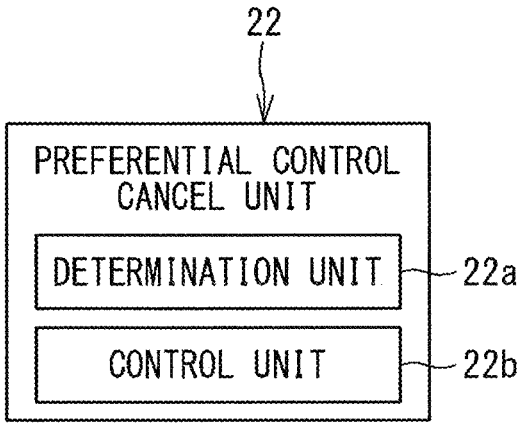
FIG. 4 is a block diagram showing a configuration of a preferential control cancel unit.

FIG. 4 is a block diagram showing the configuration of the preferential control cancel unit 22. The preferential control cancel unit 22 includes a determination unit 22*a* and a control unit 22*b*.

The determination unit 22*a* determines whether or not the vehicle 5 approaching the intersection Jk is an execution target of preferential control by the preferential control unit 21.

The control unit 22*b* has a function of causing execution of preferential control for the execution target to be suspended when a predetermined condition is satisfied, thereby canceling the preferential control.

In the present embodiment, the roadside communication device 2 having the preferential control unit 21 constitutes a preferential control device. In addition, the roadside communication device 2 also has the preferential control cancel unit 22, and constitutes a preferential control cancel device.

The processing unit 18, the processing unit 29, the processing unit 31, and the central apparatus 4 are each configured so as to include a computer having a CPU (Central Processing Unit) and a storage device, for example. The storage devices of the processing unit 18, the processing unit 29, the processing unit 31, and the central apparatus 4 store therein programs for implementing the various functions. The processing unit 18, the processing unit 29, the processing unit 31, and the central apparatus 4 can implement the various functions by executing the programs.

[Preferential Control]

Preferential control that is executed by the preferential control unit 21 is a process to be executed for an execution target of the preferential control. Specifically, the preferential control is a process of adjusting (extending or shortening) the phase of a traffic signal light 10 at an intersection Jk where a vehicle 5 as the execution target attempts to enter, to allow the vehicle 5 as the execution target to preferentially pass through the intersection Jk.

Figure 5:
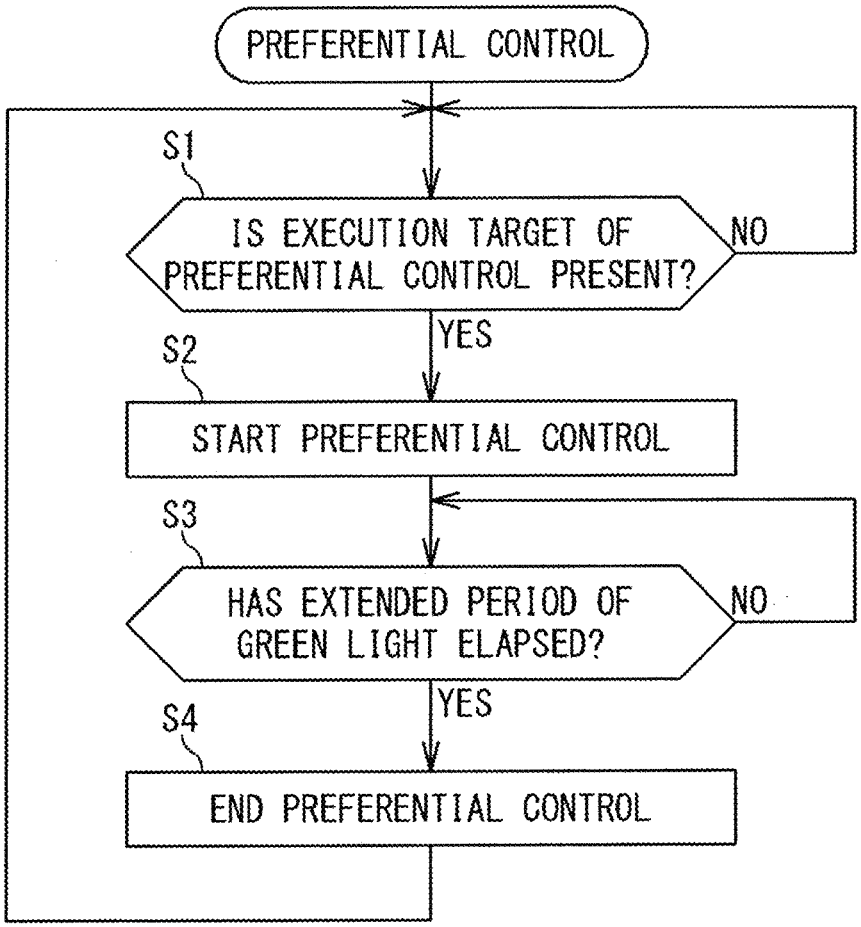
FIG. 5 is a flowchart showing an example of preferential control executed by the preferential control unit.

FIG. 5 is a flowchart showing an example of preferential control executed by the preferential control unit 21.

First, the preferential control unit 21 determines whether or not there is a vehicle 5 that can be a target vehicle as an execution target of preferential control (step S1).

In order to determine whether or not there is a vehicle 5 that can be a target vehicle, the preferential control unit 21 refers to, for example, vehicle positions, vehicle speeds, and vehicle headings that are information included in probe information transmitted from on-vehicle communication devices 3.

Based on the vehicle positions and the vehicle headings, the preferential control unit 21 specifies vehicles 5 (on-vehicle communication devices 3) approaching the intersection Jk. That is, the preferential control unit 21 detects the vehicles 5 approaching the intersection Jk by using the probe information.

Furthermore, the preferential control unit 21 determines, based on the vehicle positions and the vehicle speeds, whether or not the approaching vehicles 5 will arrive at the intersection Jk within a predetermined period (first predetermined period) that is set before and after an end timing of a green interval of the traffic signal light 10 at the intersection Jk.

The preferential control unit 21 specifies, among the approaching vehicles 5, a vehicle 5 that is determined to arrive at the intersection Jk within the first predetermined period, as a vehicle that can be a target vehicle.

The first predetermined period is a period of several seconds that is set before and after the end timing of the green interval of the traffic signal light 10.

Upon determining in step S1 that there is a vehicle 5 that can be a target vehicle, the preferential control unit 21 goes to step S2, and starts to execute preferential control with this vehicle 5 being a target vehicle (step S2). On the other hand, upon determining that there is no vehicle 5 that can be a target vehicle of preferential control, the preferential control unit 21 repeats step S1.

As the preferential control to be executed for the target vehicle, the preferential control unit 21 controls the traffic signal controller 11 so as to extend the green interval (green light) as a phase of the traffic signal light 10 at the intersection Jk. In this case, the period of the extension of the green light is set to an extent that allows the target vehicle to appropriately pass through the intersection Jk.

Thus, the target vehicle, which should have been stopped at the intersection Jk, is allowed to preferentially pass through the intersection Jk by the preferential control.

The preferential control unit 21 having started the preferential control in step S2 determines whether or not the extended period of green light has elapsed (step S3). The preferential control unit 21 repeats the determination in step S3 until the extended period of green light elapses.

When the extended period of green light has elapsed, the preferential control unit 21 goes to step S4, ends the execution of the preferential control (step S4), and returns to step S1.

[Cancel Process According to First Embodiment]

The preferential control cancel unit 22 included in the roadside communication device 2 has a function of executing a cancel process of canceling preferential control being executed by the preferential control unit 21.

Figure 6:
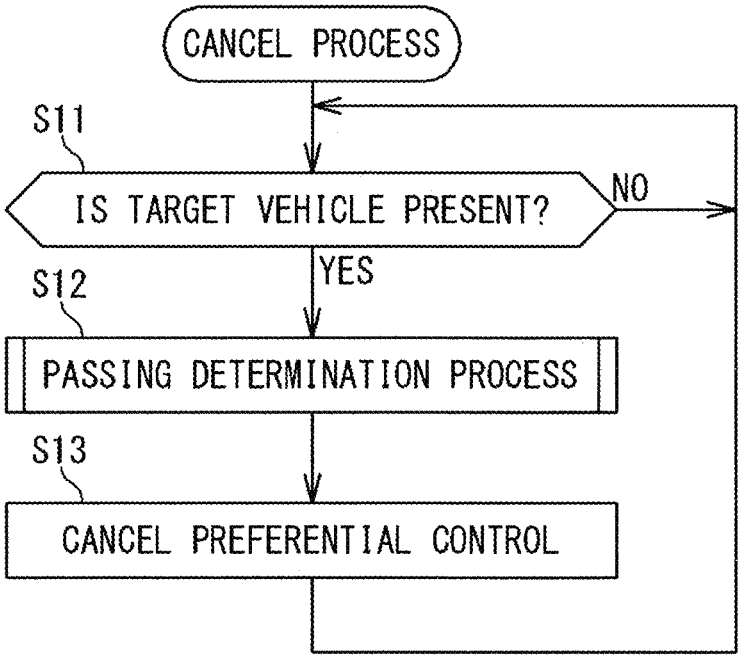
FIG. 6 is a flowchart showing an example of a cancel process according to a first embodiment.

FIG. 6 is a flowchart showing an example of a cancel process according to the first embodiment.

First, (the determination unit 22*a* of) the preferential control cancel unit 22 determines whether or not there is a target vehicle (step S11).

The preferential control cancel unit 22 acquires information indicating presence/absence of a target vehicle from the preferential control unit 21, and determines whether or not there is a target vehicle on the basis of the information indicating presence/absence of a target vehicle.

When there is no target vehicle, the preferential control cancel unit 22 repeats step S11 until it determines that there is a target vehicle.

Thus, the preferential control cancel unit 22 determines whether or not there is a target vehicle by using the information obtained from the preferential control unit 21, and determines whether or not a vehicle 5 approaching the intersection Jk is the target vehicle.

Upon determining in step S11 that a target vehicle is present, (the control unit 22*b* of) the preferential control cancel unit 22 goes to step S12, and executes a passing determination process (step S12).

The passing determination process is a process of determining whether or not the target vehicle can pass through the intersection Jk before the preferential control ends. The passing determination process is configured such that, when it is determined that the target vehicle cannot pass through the intersection Jk before the preferential control ends or that the preferential control need not be executed anymore, the process is ended; otherwise, the process is continued.

The preferential control cancel unit 22 that has ended the passing determination process in step S12 goes to step S13, and causes the preferential control unit 21 to cancel execution of the preferential control for the target vehicle (step S13).

Figure 7:
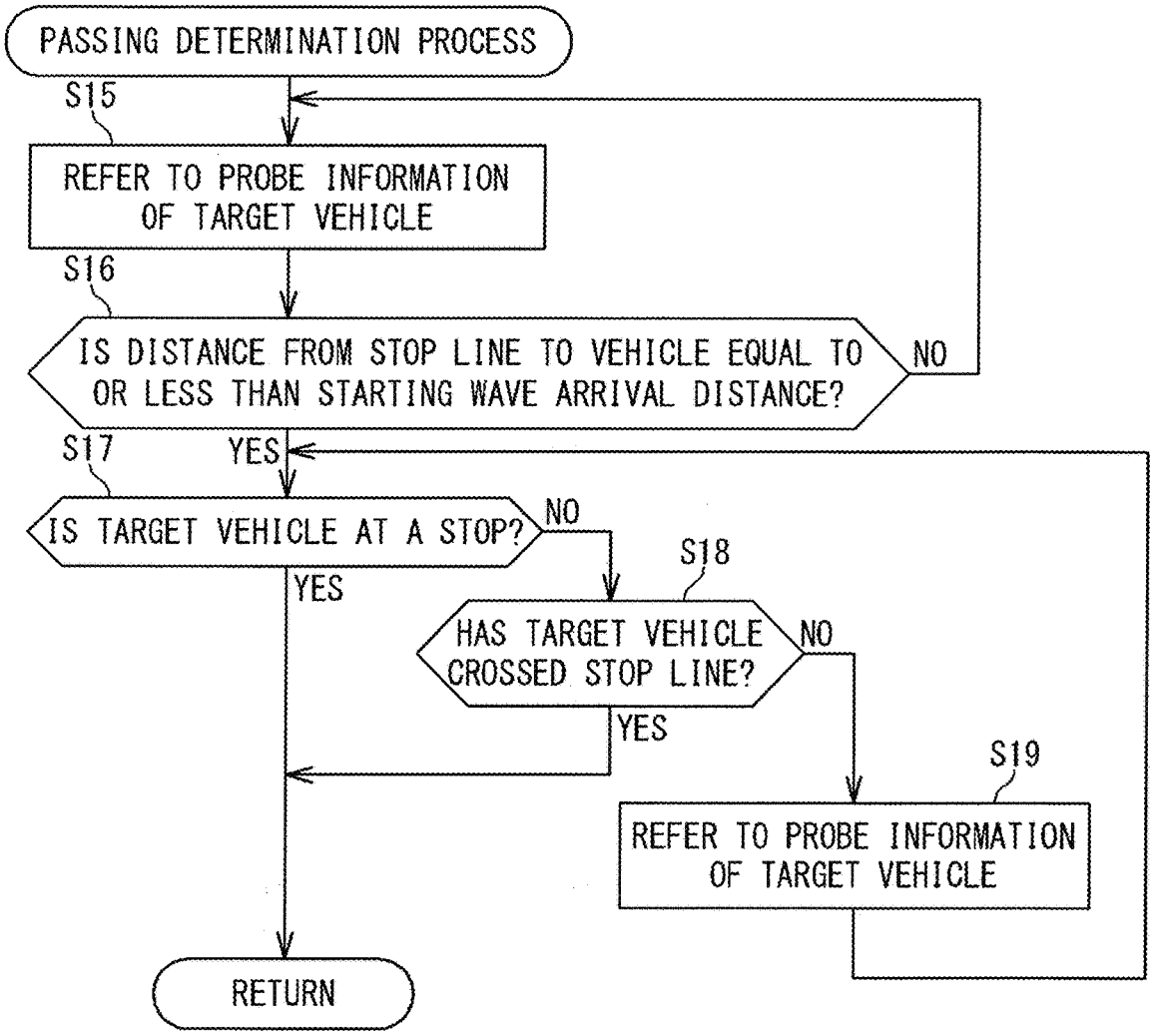
FIG. 7 is a flowchart showing an example of a passing determination process.

FIG. 7 is a flowchart showing an example of the passing determination process.

In the passing determination process, first, the preferential control cancel unit 22 refers to the current position and speed of a target vehicle which are included in the probe information of the target vehicle (step S15).

Next, the preferential control cancel unit 22 determines whether or not the distance from a stop line of the intersection Jk to the target vehicle is equal to or less than a starting wave arrival distance (step S16).

When the traffic signal light changes to green while a queue of vehicles are waiting for the signal change to occur, the vehicles successively start to move from those closer to the intersection Jk. When the vehicles waiting for the signal change successively start to move, start timings propagate from forward vehicles toward rearward vehicles like a wave, and this propagation wave is referred to as a starting wave. Therefore, the starting wave is represented by the relationship between time and the distances from the starting vehicles to the stop line.

Figure 8:
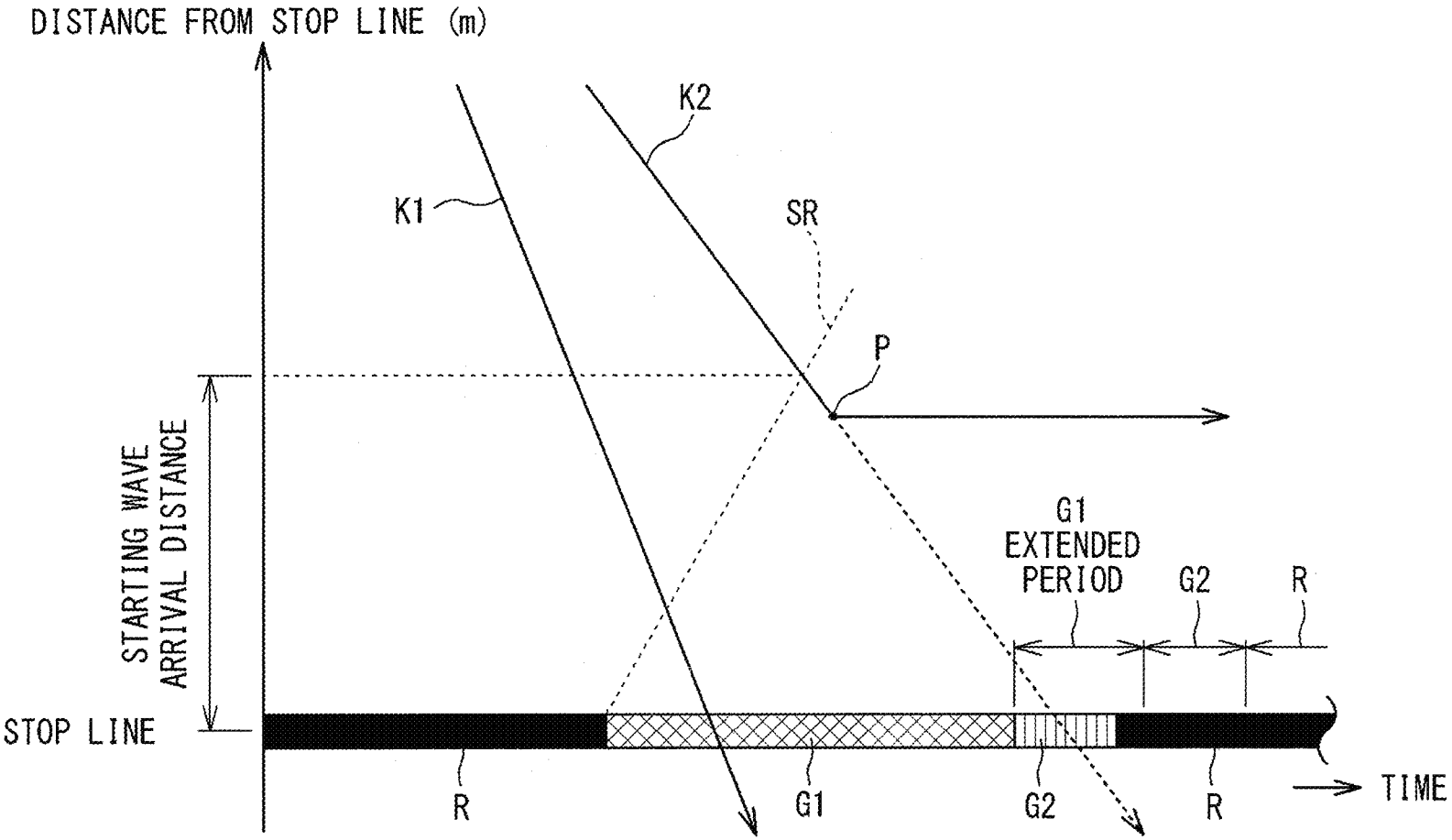
FIG. 8 is a graph showing the relationship between a travel trail of a vehicle and a starting wave.

FIG. 8 is a graph showing the relationship between travel trails of vehicles 5 and a starting wave. In FIG. 8, the horizontal axis indicates time, and the vertical axis indicates the distance from the stop line of the intersection Jk. On the horizontal axis, a black-marked part R indicates a red interval, a cross-hatched part G1 indicates a green interval, and a vertically-hatched part G2 indicates a right-turn arrow signal interval at the intersection Jk.

In FIG. 8, a broken line SR indicates starting positions and times of a plurality of vehicles 5 when the vehicles 5, which queue from the stop line, start to move with a green light. When the traffic signal light changes to green, the vehicles 5 successively start to move from one at the head of the waiting queue. The starting positions of the respective vehicles 5 that successively start to move have a propagation speed that extends to the upstream side with time. The broken line SR having the gradient of the propagation speed represents the starting wave.

Here, it is assumed that the preferential control unit 21 of the present embodiment is configured to be able to execute preferential control by extending the interval of green light that allows straight-traveling vehicles and right/left-turn vehicles to pass through, and does not execute preferential control by extending the interval of a right-turn arrow signal, for example.

In FIG. 8, a travel trail K1 indicates a travel trail of a vehicle 5 that is not specified to be a target vehicle of preferential control by the preferential control unit 21. This travel trail K1 indicates that, if the vehicle 5 travels at a constant speed, the vehicle 5 can cross the stop line within the green interval G1. In addition, the travel trail K1 indicates that the vehicle 5 can cross the stop line with a sufficient time up to the timing at which the green light changes to red light (right-turn arrow signal).

Meanwhile, a travel trail K2 in FIG. 8 indicates a travel trail of a vehicle 5 that is specified as a target vehicle of preferential control by the preferential control unit 21. This travel trail K2 indicates that the vehicle 5 stops at an intermediate point P, and a broken line portion thereof extending from the intermediate point P indicates a trail when the vehicle 5 travels at a constant speed.

The broken line portion of the travel trail K2 indicates that, if the vehicle 5, which attempts to travel straight, travels at a constant speed, the vehicle 5 will cross the stop line within the right-turn arrow signal interval G2. In this case, the preferential control unit 21 specifies that the vehicle 5 is a target vehicle on the basis of the trail indicated by a solid line portion on the upstream side relative to the intermediate point P, and performs preferential control to extend the green interval G1 so that the vehicle can pass through the intersection Jk.

As shown in FIG. 8, the starting wave arrival distance is a distance from a point where the broken line SR indicating the starting wave crosses the travel trail K2, to the stop line.

The preferential control cancel unit 22 has a mathematical expression that expresses the broken line SR that is obtained by calculating the starting wave at the intersection Jk in advance, and therefore, can calculate the starting wave arrival distance on the basis of the position and speed of the target vehicle.

The preferential control cancel unit 22 calculates the starting wave arrival distance on the basis of the position and speed of the target vehicle, and determines whether or not the distance from the stop line to the target vehicle is equal to or less than the starting wave arrival distance (step S16 in FIG. 7).

In FIG. 7, upon determining in step S16 that the distance from the stop line to the target vehicle is neither equal to nor less than the starting wave arrival distance, the preferential control cancel unit 22 returns to step S15, and executes step S15 again with reference to the current position and speed of the target vehicle which are included in the probe information of the target vehicle.

Upon determining in step S16 that the distance from the stop line to the target vehicle is equal to or less than the starting wave arrival distance, the preferential control cancel unit 22 determines whether or not the target vehicle is at a stop (step S17). The preferential control cancel unit 22 performs the determination as to whether the target vehicle is at a stop, by determining, for example, whether or not the current speed of the target vehicle is equal to or less than a speed with which the target vehicle can be determined to be at a "stop".

Upon determining that the target vehicle is at a stop, the preferential control cancel unit 22 ends the passing determination process and returns to the flowchart of FIG. 6. Further, the preferential control cancel unit 22 goes to step S13 in FIG. 6, and causes the preferential control unit 21 to cancel execution of the preferential control for the target vehicle (step S13 in FIG. 6).

When the target vehicle is stopped at a position where the distance from the stop line to the target vehicle is equal to or less than the starting wave arrival distance, even if the preferential control unit 21 extends the green interval G1 (FIG. 8) as shown in FIG. 8, the possibility that the target vehicle will cross the stop line within the green interval G1 is lowered. That is, there is a risk that the target vehicle cannot cross the stop line before the preferential control by the preferential control unit 21 ends.

In this case, the extension of the green interval G1, which is performed through execution of the preferential control by the preferential control unit 21, will be wasted.

Therefore, when the preferential control cancel unit 22 of the present embodiment has determined that the target vehicle is at a stop (step S17), the preferential control cancel unit 22 determines that the target vehicle cannot cross the stop line before the preferential control ends, and causes the preferential control unit 21 to cancel execution of the preferential control for the target vehicle (step S13 in FIG. 6). As a result, the preferential control is inhibited from being unnecessarily executed.

Meanwhile, upon determining in step S17 that the target vehicle is not at a stop, the preferential control cancel unit 22 determines whether or not the target vehicle has crossed the stop line (step S18).

If the target vehicle has crossed the stop line, the preferential control cancel unit 22 determines that execution of the preferential control for the target vehicle need not be maintained, ends the passing determination process, and returns to the flowchart of FIG. 6. Further, the preferential control cancel unit 22 goes to step S13 in FIG. 6, and causes the preferential control unit 21 to cancel execution of the preferential control for the target vehicle (step S13 in FIG. 6). In this case, since the target vehicle has crossed the stop line, the preferential control unit 21 may have already ended the preferential control for the target vehicle.

If the target vehicle has not crossed the stop line yet (step S18), the preferential control cancel unit 22 refers to the current position and speed of the target vehicle which are included in the probe information of the target vehicle (step S19), and returns to step S17 to determine whether or not the target vehicle is at a stop.

Thus, the control cancel unit 22 repeats step S17, step S18, and step S19 until the target vehicle is stopped or crosses the stop line, thereby maintaining execution of the preferential control.

As described above, according to the present embodiment, after the determination unit 22*a* has determined that a vehicle 5 approaching the intersection Jk is a target vehicle as an execution target of preferential control, if a predetermined condition that the preferential control cancel unit 22 determines that the target vehicle cannot cross the stop line before the preferential control by the preferential control unit 21 ends, is satisfied, execution of the preferential control by the preferential control unit 21 can be canceled. As a result, the preferential control is inhibited from being unnecessarily executed.

Furthermore, in the present embodiment, the aforementioned predetermined condition that the preferential control cancel unit 22 determines that the target vehicle cannot cross the stop line before the preferential control ends is satisfied when the preferential control cancel unit 22 determines that the distance from the stop line to the target vehicle is equal to or less than the starting wave arrival distance (step S16) and that the target vehicle is at a stop (step S17).

[First Modification of First Embodiment]

Figure 9:
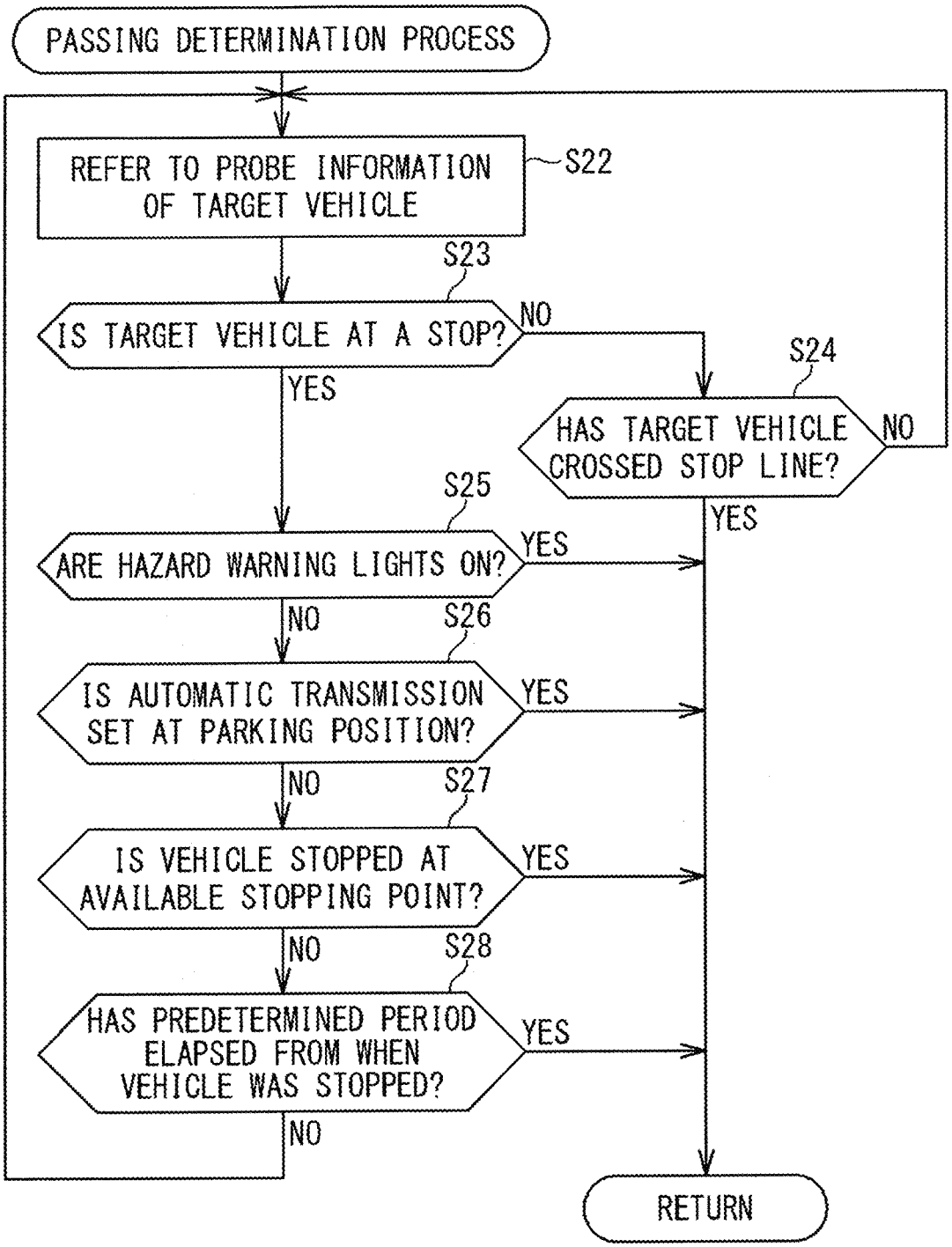
FIG. 9 is a flowchart showing an example of a passing determination process according to a first modification of the first embodiment.

FIG. 9 is a flowchart showing an example of a passing determination process according to a first modification of the first embodiment.

The preferential control cancel unit 22 according to the present modification is different from that of the first embodiment in that the passing determination process adopts settings of hazard warning lights and an automatic transmission of a target vehicle, and the position of the target vehicle.

In FIG. 9, first, the preferential control cancel unit 22 refers to the current position and speed, blinker information, and transmission information of the target vehicle, which are included in the probe information of the target vehicle (step S22).

Next, the preferential control cancel unit 22 determines whether or not the target vehicle is at a stop (step S23). If the target vehicle is not at a stop, the preferential control cancel unit 22 determines whether or not the target vehicle has crossed the stop line (step S24).

If the target vehicle has crossed the stop line, the preferential control cancel unit 22 determines that execution of the preferential control for the target vehicle need not be maintained, ends the passing determination process, and returns to the flowchart of FIG. 6. Therefore, the preferential control cancel unit 22 causes the preferential control unit 21 to cancel execution of the preferential control for the target vehicle (step S13 in FIG. 6). In this case, since the target vehicle has crossed the stop line, the preferential control unit 21 may have already ended the preferential control for the target vehicle.

If the target vehicle has not crossed the stop line yet (step S24), the preferential control cancel unit 22 returns to step S22.

Thus, the preferential control cancel unit 22 repeats step S22, step S23, and step S24 until the target vehicle is stopped or crosses the stop line, thereby maintaining execution of the passing determination process. Thus, the preferential control cancel unit 22 maintains execution of the preferential control.

Upon determining in step S23 that the target vehicle is at a stop, the preferential control cancel unit 22 refers to the blinker information to determine whether or not the hazard warning lights of the target vehicle are ON (step S25).

If the hazard warning lights of the target vehicle are ON, the preferential control cancel unit 22 ends the passing determination process, and returns to the flowchart of FIG. 6. Therefore, the preferential control cancel unit 22 causes the preferential control unit 21 to cancel execution of the preferential control for the target vehicle (step S13 in FIG. 6).

In step S25, if the hazard warning lights of the target vehicle are not ON (are OFF), the preferential control cancel unit 22 refers to the transmission information, and determines whether or not the automatic transmission of the target vehicle is set at a parking position (step S26).

If the automatic transmission of the target vehicle is set at the parking position, the preferential control cancel unit 22 ends the passing determination process, and returns to the flowchart of FIG. 6. Thus, the preferential control cancel unit 22 causes the preferential control unit 21 to cancel execution of the preferential control for the target vehicle (step S13 in FIG. 6).

Upon determining in step S26 that the automatic transmission of the target vehicle is not set at the parking position, the preferential control cancel unit 22 refers to the vehicle position, and determines whether or not the target vehicle is stopped at an available stopping point such as a lay-by (step S27).

When the position of the target vehicle is at the available stopping point, the preferential control cancel unit 22 ends the passing determination process, and returns to the flowchart of FIG. 6. Thus, the preferential control cancel unit 22 causes the preferential control unit 21 to cancel execution of the preferential control for the target vehicle (step S13 in FIG. 6).

Figure 10:
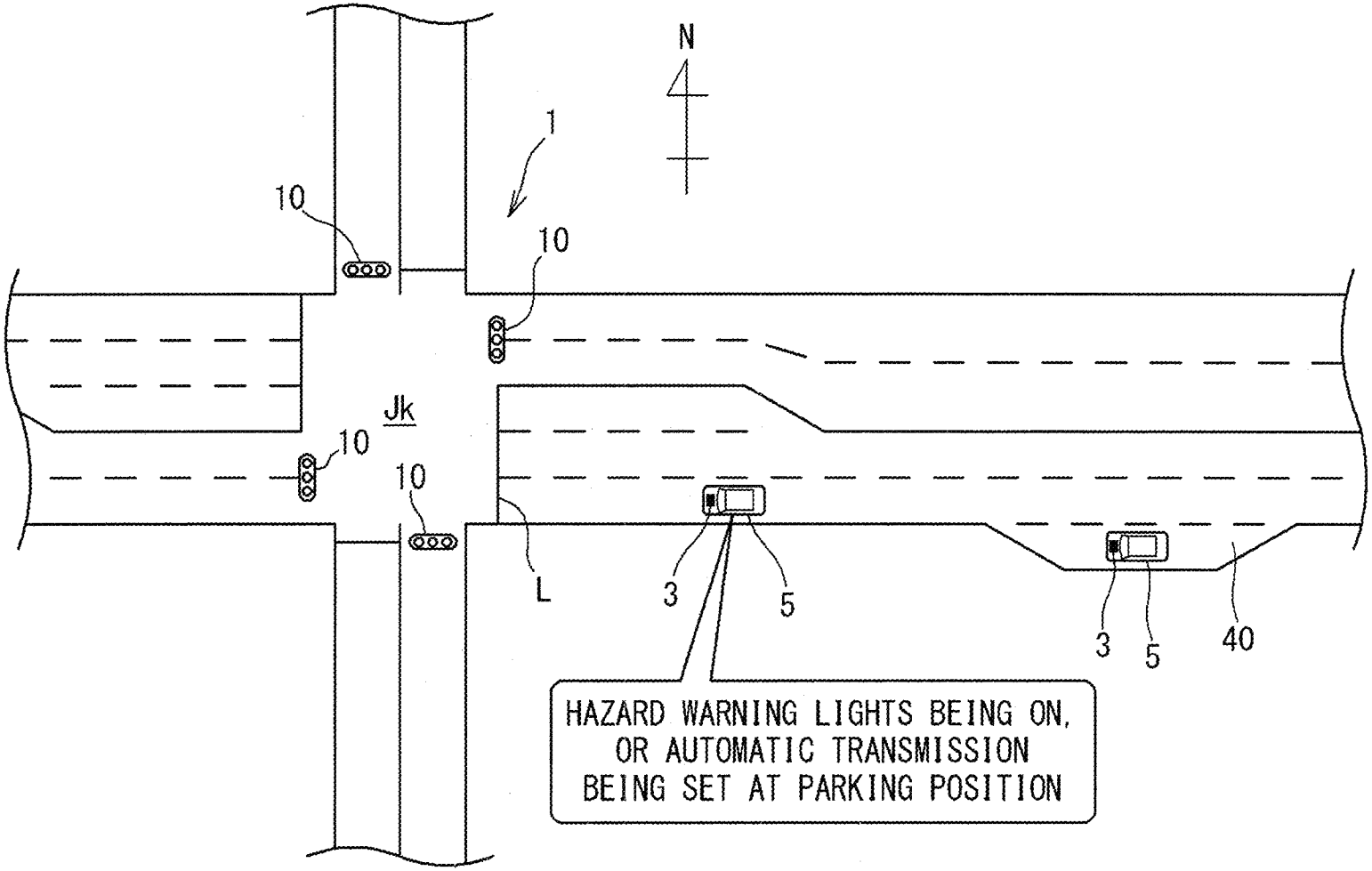
FIG. 10 shows target vehicles that are stopped upstream of an intersection.

FIG. 10 shows target vehicles that are stopped upstream from the intersection Jk.

As shown in FIG. 10, when a vehicle 5 as a target vehicle is stopped on a traffic lane with the hazard warning lights being ON, even if the traffic signal light 10 ahead of the vehicle 5 is green, this vehicle 5 is highly likely to maintain the stopping state.

Further, as shown in FIG. 10, when a vehicle 5 as a target vehicle is stopped on the traffic lane and the automatic transmission thereof is set at the parking position, even if the traffic signal light 10 ahead of the vehicle 5 is green, this vehicle 5 is highly likely to maintain the stopping state.

Further, as shown in FIG. 10, when a vehicle 5 as a target vehicle is stopped in an available stopping point such as a lay-by 40, even if the traffic signal light 10 ahead of the vehicle 5 is green, this vehicle 5 is highly likely to maintain the stopping state.

When the state of a vehicle 5 as a target vehicle corresponds to any one of the following three states, this vehicle 5 is highly likely to maintain its stopping state.

- The vehicle 5 as a target vehicle is stopped on the traffic lane with the hazard warning lights being ON (corresponding to step S25).
- The automatic transmission of the vehicle 5 as a target vehicle is set at the parking position (corresponding to step S26).
- The vehicle 5 as a target vehicle is stopped at an available stopping point such as the lay-by 40 (corresponding to step S27).

Therefore, in the above cases, even if the preferential control unit 21 extends the green interval, the possibility that the target vehicle will cross the stop line L within the green interval is reduced. That is, there is a risk that the target vehicle cannot cross the stop line L before the preferential control by the preferential control unit 21 ends.

Therefore, when the preferential control cancel unit 22 according to the present modification has determined that the target vehicle is at a stop (step S23) and further determined that the stopping state corresponds to any one of the hazard warning lights of the target vehicle being ON (step S25), the automatic transmission of the target vehicle being set at the parking position (step S26), and the target vehicle being stopped at the available stopping point (step S27), the preferential control cancel unit 22 determines that the target vehicle cannot cross the stop line L before the preferential control ends, and causes the preferential control unit 21 to cancel execution of the preferential control for the target vehicle. As a result, the preferential control is inhibited from being unnecessarily executed.

Referring back to FIG. 9, if the stopping state does not correspond to any of step S25, step S26, and step S27, the preferential control cancel unit 22 determines whether or not a predetermined period (second predetermined period) has elapsed from when the target vehicle was stopped (step S28).

Upon determining that the second predetermined period has not elapsed from when the target vehicle was stopped, the preferential control cancel unit 22 returns to step S22 and repeats the aforementioned processing again.

On the other hand, upon determining that the second predetermined period has elapsed from when the target vehicle was stopped, the preferential control cancel unit 22 ends the passing determination process, and returns to the flowchart in FIG. 6. Further, the preferential control cancel unit 22 goes to step S13 in FIG. 6, and causes the preferential control unit 21 to cancel execution of the preferential control for the target vehicle (step S13 in FIG. 6). In this case, although the stopping state of the target vehicle does not correspond to any of step S25, step S26, and step S27, when the second predetermined period has elapsed, the preferential control cancel unit 22 can determine that the target vehicle cannot cross the stop line L before the preferential control ends. Therefore, in this case, the preferential control is inhibited from being unnecessarily executed. The second predetermined period in step S28 is set to a time period that allows the preferential control cancel unit 22 to determine that, even if the vehicle 5 as a target vehicle resumes traveling, the vehicle 5 cannot cross the stop line L before the preferential control ends.

As described above, in the present modification, after the determination unit 22*a* has determined that a vehicle 5 approaching the intersection Jk is a target vehicle as an execution target of preferential control, if a predetermined condition that the preferential control cancel unit 22 determines that the target vehicle cannot cross the stop line L before the preferential control by the preferential control unit 21 ends, is satisfied, execution of the preferential control by the preferential control unit 21 can be canceled.

Further, in the present modification, the aforementioned predetermined condition that the preferential control cancel unit 22 determines that the target vehicle cannot cross the stop line L before the preferential control ends, is satisfied when the preferential control cancel unit 22 has determined that the target vehicle is at a stop (step S23) and further determined that the stopping state is any one of the hazard warning lights of the target vehicle being ON (step S25), the automatic transmission of the target vehicle being set at the parking position (step S26), and the target vehicle being stopped at the available stopping point (step S27).

[Second Modification of First Embodiment]

Figure 11:
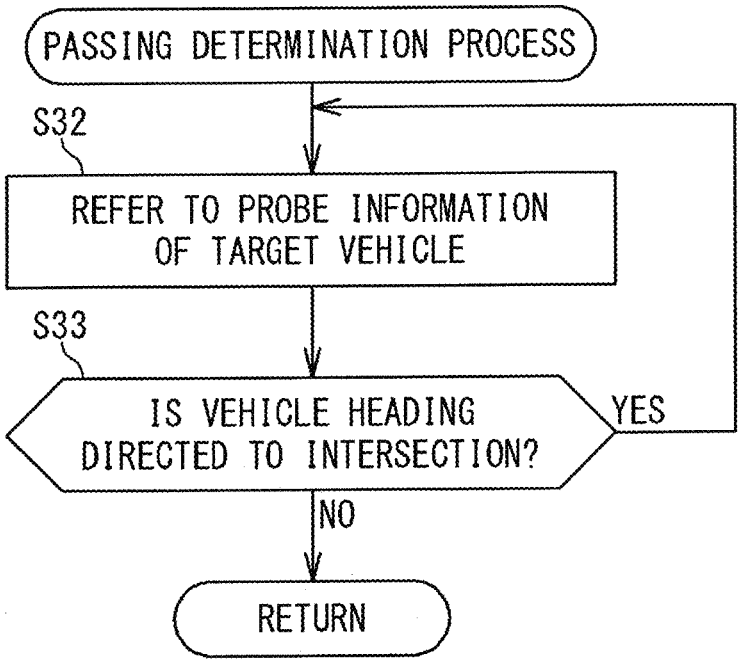
FIG. 11 is a flowchart showing an example of a passing determination process according to a second modification of the first embodiment.

FIG. 11 is a flowchart showing an example of a passing determination process according to a second modification of the first embodiment.

The preferential control cancel unit 22 of the present modification is different from that of the first embodiment in that whether or not a target vehicle can cross the stop line L before the preferential control ends is determined based on whether or not the target vehicle has turned right or left on the upstream side of the intersection Jk.

In FIG. 11, first, the preferential control cancel unit 22 refers to the current position, speed, and heading of the target vehicle which are included in the probe information of the target vehicle (step S32).

Next, the preferential control cancel unit 22 determines whether or not the heading of the target vehicle is directed to the intersection Jk (step S33). Upon determining that the heading of the target vehicle is directed to the intersection Jk, the preferential control cancel unit 22 returns to step S32. In this case, the preferential control cancel unit 22 determines that the target vehicle is traveling toward the intersection Jk, and repeats step S32 and step S33.

Upon determining in step S33 that the heading of the target vehicle is not directed to the intersection Jk, the preferential control cancel unit 22 ends the passing determination process, and returns to the flowchart of FIG. 6. Thus, the preferential control cancel unit 22 causes the preferential control unit 21 to cancel execution of the preferential control for the target vehicle (step S13 in FIG. 6).

Figure 12:
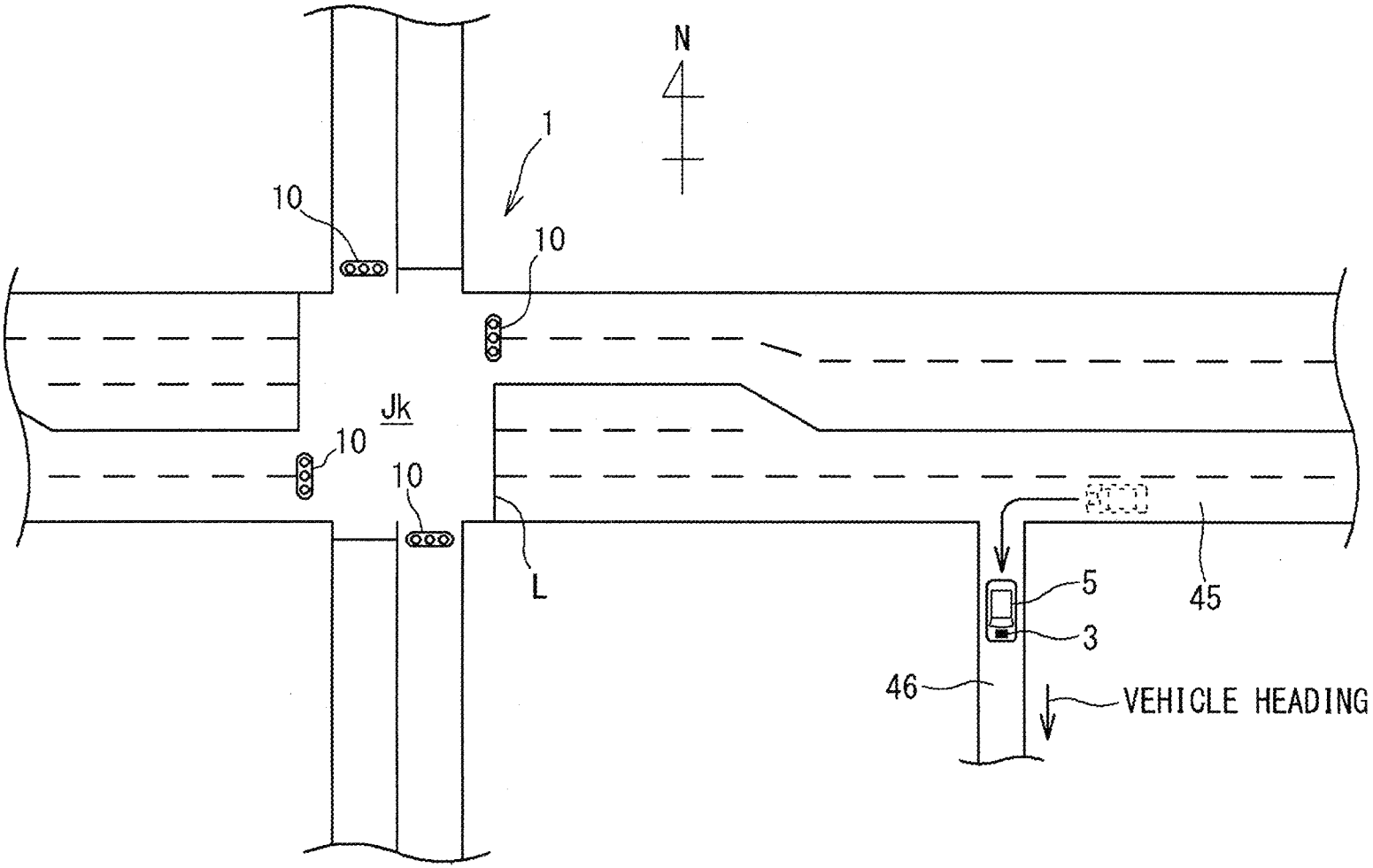
FIG. 12 shows a target vehicle that turns left to enter a side road on the upstream side of the intersection.

FIG. 12 shows a target vehicle that turns left to enter a side road on the upstream side of the intersection Jk.

As shown in FIG. 12, when a vehicle 5 as a target vehicle, traveling on the road 45 toward the intersection Jk, turns left to enter a side road 46 connected to the road 45 on the upstream side of the intersection Jk, the heading of the vehicle 5 is directed in a direction completely different from the direction toward the intersection Jk.

Therefore, if the heading of the vehicle 5 as the target vehicle is not directed to the intersection Jk, this vehicle 5 is not traveling toward the intersection Jk and is highly likely to turn right or left to enter the side road.

In this case, even if the preferential control unit 21 extends the green interval, the possibility that the target vehicle crosses the stop line L within the green interval is reduced. That is, there is a risk that the target vehicle cannot cross the stop line L before the preferential control by the preferential control unit 21 ends.

Therefore, if the heading of the target vehicle is not directed to the intersection Jk, the preferential control cancel unit 22 according to the present modification determines that the target vehicle has turned right or left on the upstream side of the intersection Jk. Further, upon determining that the target vehicle has turned right or left on the upstream side of the intersection Jk, the preferential control cancel unit 22 determines that the target vehicle cannot cross the stop line L before the preferential control ends, and causes the preferential control unit 21 to cancel execution of the preferential control for the target vehicle. As a result, the preferential control is inhibited from being unnecessarily executed.

After the target vehicle has passed through the intersection Jk, the heading of the target vehicle is not directed to the intersection Jk anymore. In this case, the preferential control cancel unit 22 also causes the preferential control unit 21 to cancel execution of the preferential control for the target vehicle. In this case, since the target vehicle has passed through (the stop line of) the intersection Jk, the preferential control unit 21 may have already ended the preferential control for the target vehicle.

As described above, in the present modification, after the determination unit 22*a* has determined that a vehicle 5 approaching the intersection Jk is a target vehicle as an execution target of preferential control, if a predetermined condition that the preferential control cancel unit 22 determines that the target vehicle cannot cross the stop line L before the preferential control by the preferential control unit 21 ends, is satisfied, execution of the preferential control by the preferential control unit 21 can be canceled.

Furthermore, in the present modification, the aforementioned predetermined condition that the preferential control cancel unit 22 determines that the target vehicle cannot cross the stop line L before the preferential control ends is satisfied when the preferential control cancel unit 22 has determined that the heading of the target vehicle is not directed to the intersection Jk (step S32).

In the present modification, the determination as to whether or not the target vehicle has turned right or left on the upstream side of the intersection Jk is made based on the heading of the target vehicle. However, the determination as to whether or not the target vehicle has turned right or left on the upstream side of the intersection Jk may be made based on whether or not the position of the target vehicle is within a predetermined area that is set on the road upstream of the intersection Jk. In the case where such a predetermined area is set, this predetermined area allows determination that the target vehicle is traveling toward the intersection Jk if the position of the target vehicle is within the predetermined area, and allows determination that the target vehicle has turned right or let on the upstream side of the intersection Jk if the position of the target vehicle shifts to the outside of the predetermined area.

Second Embodiment

A preferential control cancel unit 22 of a roadside communication device 2 according to the second embodiment is configured to compare a direction which is obtained based on probe information of the target vehicle and in which a target vehicle will advance when passing through an intersection Jk, with the content of preferential control for the target vehicle, and determine whether or not to cancel the preferential control on the basis of the result of the comparison.

Furthermore, an on-vehicle communication device 3 according to the present embodiment has a function of transmitting a preferential control request for requesting preferential control to (the preferential control unit 21 of) the roadside communication device 2.

The preferential control unit 21 of the roadside communication device 2 is configured to start preferential control upon receiving the preferential control request transmitted from a vehicle 5.

The preferential control that is executed by the preferential control unit 21 of the present embodiment is to extend the green interval for a target vehicle traveling straight in the intersection Jk, thereby allowing the target vehicle to preferentially pass through the intersection Jk.

That is, the content of the preferential control that is executed by the preferential control unit 21 of the present embodiment is to extend the green interval for the target vehicle traveling straight in the intersection Jk.

The preferential control request from the vehicle 5 includes request direction information indicating a direction (straight advancing direction, right-turn direction, and left-turn direction) for which the vehicle 5 requests preferential control. That is, the request direction information indicates a direction in which the vehicle 5 is planned to travel when the vehicle 5 passes through the intersection Jk.

When the request direction information included in the preferential control request is the straight advancing direction, the preferential control unit 21 executes preferential control for, as a target vehicle, the vehicle 5 having transmitted the preferential control request.

On the other hand, when the request direction information is the right-turn or left-turn direction, the preferential control unit 21 does not execute preferential control for the vehicle 5 having transmitted the preferential control request.

Figure 13:
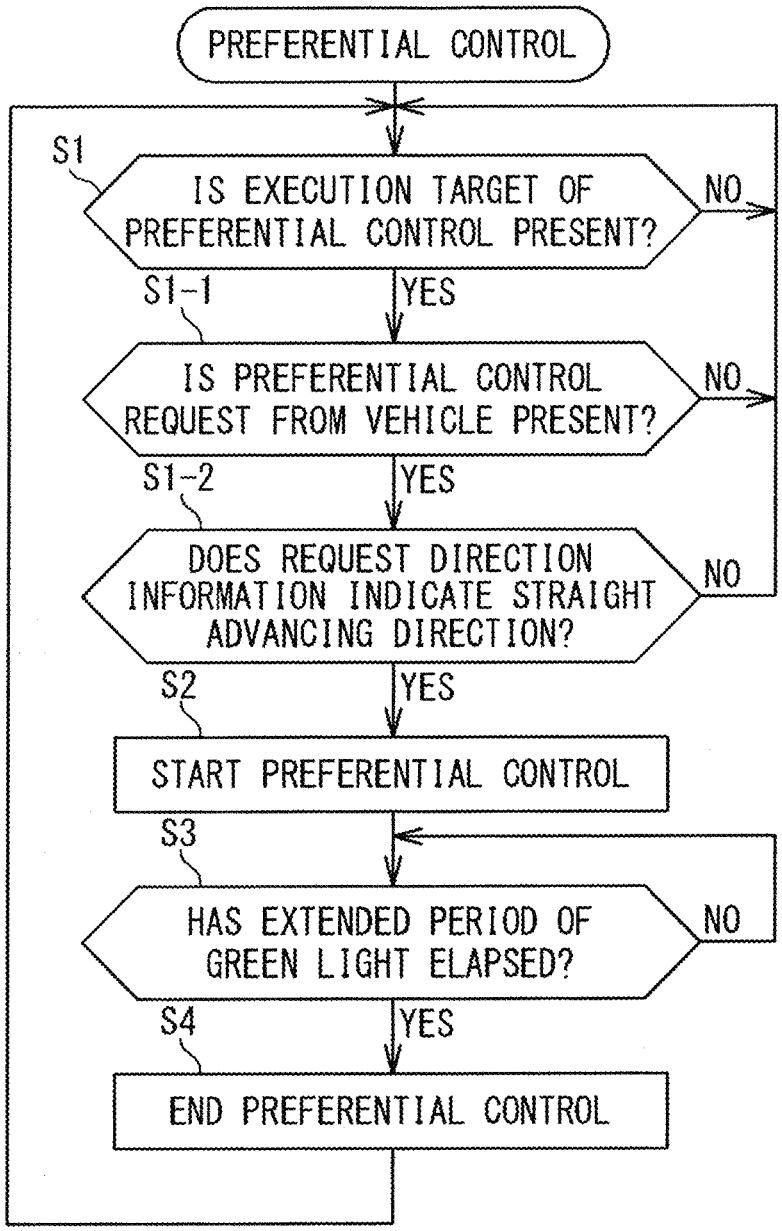
FIG. 13 is a flowchart showing an example of preferential control executed by a preferential control unit according to a second embodiment.

FIG. 13 is a flowchart showing an example of preferential control executed by the preferential control unit 21 according to the second embodiment.

The flowchart shown in FIG. 13 is different from the flowchart of FIG. 5 only in that step S1-1 and step S1-2 are added between step S1 and step S2. Therefore, only these steps S1-1 and S1-2 and steps before and after these steps will be described while description of other steps is omitted.

In step S1, upon determining that there is a vehicle 5 that can be a target vehicle, the preferential control unit 21 goes to step S1-1, and determines whether or not a preferential control request has been received from the vehicle 5 that can be a target vehicle (step S1-1).

Upon determining in step S1-1 that a preferential control request has been received from the vehicle 5 that can be a target vehicle, the preferential control unit 21 refers to request direction information included in the received preferential control request, and determines whether or not the request direction information is the straight advancing direction (step S1-2).

Upon determining in step S1 that there is no vehicle 5 that can be a target vehicle, or upon determining in step S1-1 that a preferential control request is not received from the vehicle 5 that can be a target vehicle, the preferential control unit 21 returns to step S1 and repeats the above processing.

Upon determining in step S1-2 that the request direction information is the straight advancing direction, the preferential control unit 21 goes to step S2 and starts execution of preferential control for this vehicle 5 as a target vehicle (step S2). In this case, since there is no contradiction between the direction indicated by the request direction information and the content of the preferential control to be executed for the target vehicle by the preferential control unit 21, the preferential control unit 21 starts the preferential control.

Based on the request direction information included in the preferential control request, the preferential control unit 21 specifies a signal phase to be adjusted, and adjusts (extends or shortens) the specified signal phase. Thus, the preferential control unit 21 allows the target vehicle to preferentially pass through the intersection Jk.

On the other hand, upon determining that the request direction information is not the straight advancing direction, the preferential control unit 21 returns to step S1 and repeats the above processing.

As described above, the preferential control unit 21 of the present embodiment specifies a vehicle 5 that can be a target vehicle of preferential control, receives a preferential control request from this vehicle 5, and starts execution of preferential control with the vehicle 5 being a target vehicle, upon determining that the request direction information included in the received preferential control request is the straight advancing direction.

Figure 14:
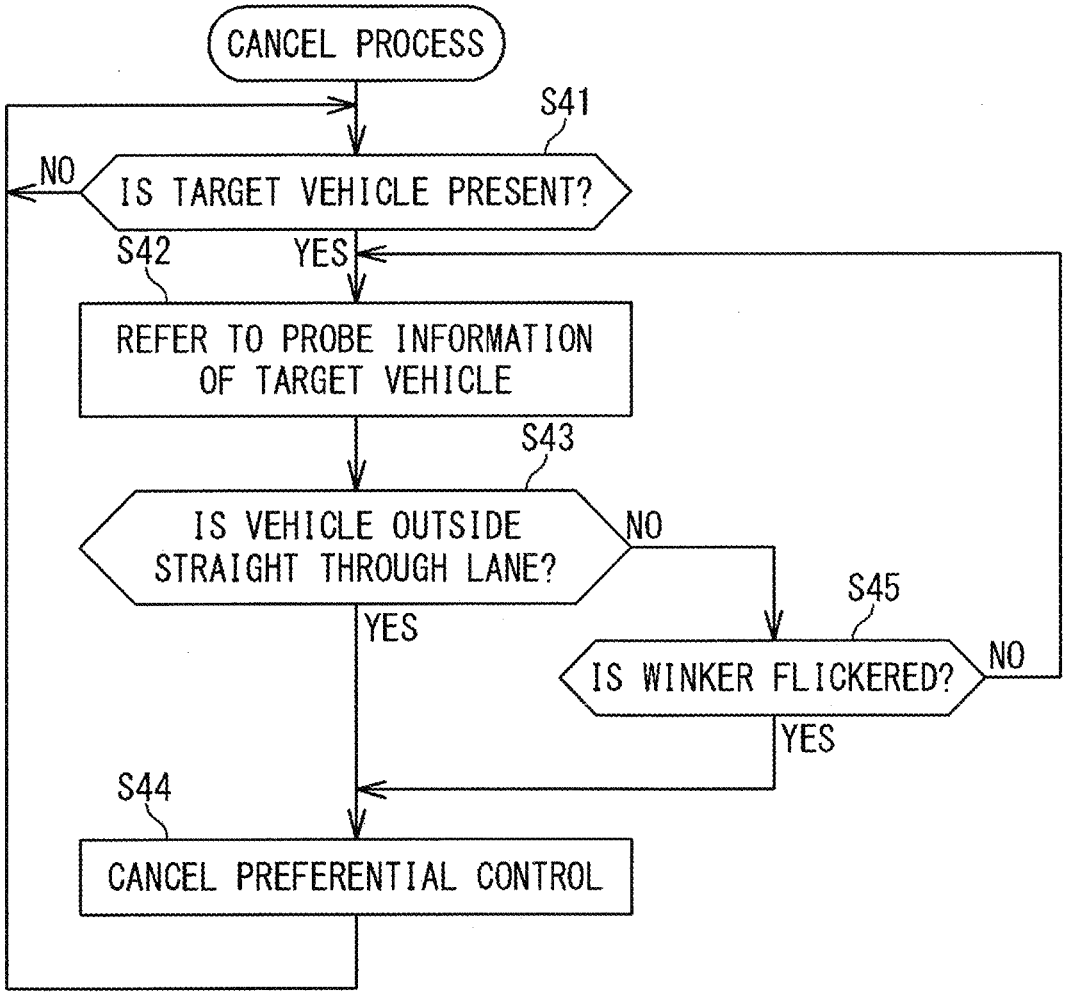
FIG. 14 is a flowchart showing an example of a cancel process according to the second embodiment.

FIG. 14 is a flowchart showing an example of a cancel process according to the second embodiment.

First, (the determination unit 22*a* of) the preferential control cancel unit 22 determines whether or not there is a target vehicle (step S41).

Upon determining that there is no target vehicle, the preferential control cancel unit 22 repeats step S41 until determining that there is a target vehicle. This step S41 is identical to step S11 in FIG. 6.

Upon determining in step S41 that there is a target vehicle, (the control unit 22*b* of) the preferential control cancel unit 22 goes to step S42, and refers to the current position and speed, blinker information, and the like of the target vehicle which are included in the probe information of the target vehicle (step S42).

Next, based on the position of the target vehicle, the preferential control cancel unit 22 determines whether or not the target vehicle is traveling on a lane other than a straight through lane (step S43).

Upon determining in step S43 that the target vehicle is traveling on a lane other than the straight through lane, the preferential control cancel unit 22 goes to step S44, and causes the preferential control unit 21 to cancel execution of the preferential control for the target vehicle.

Figure 15:
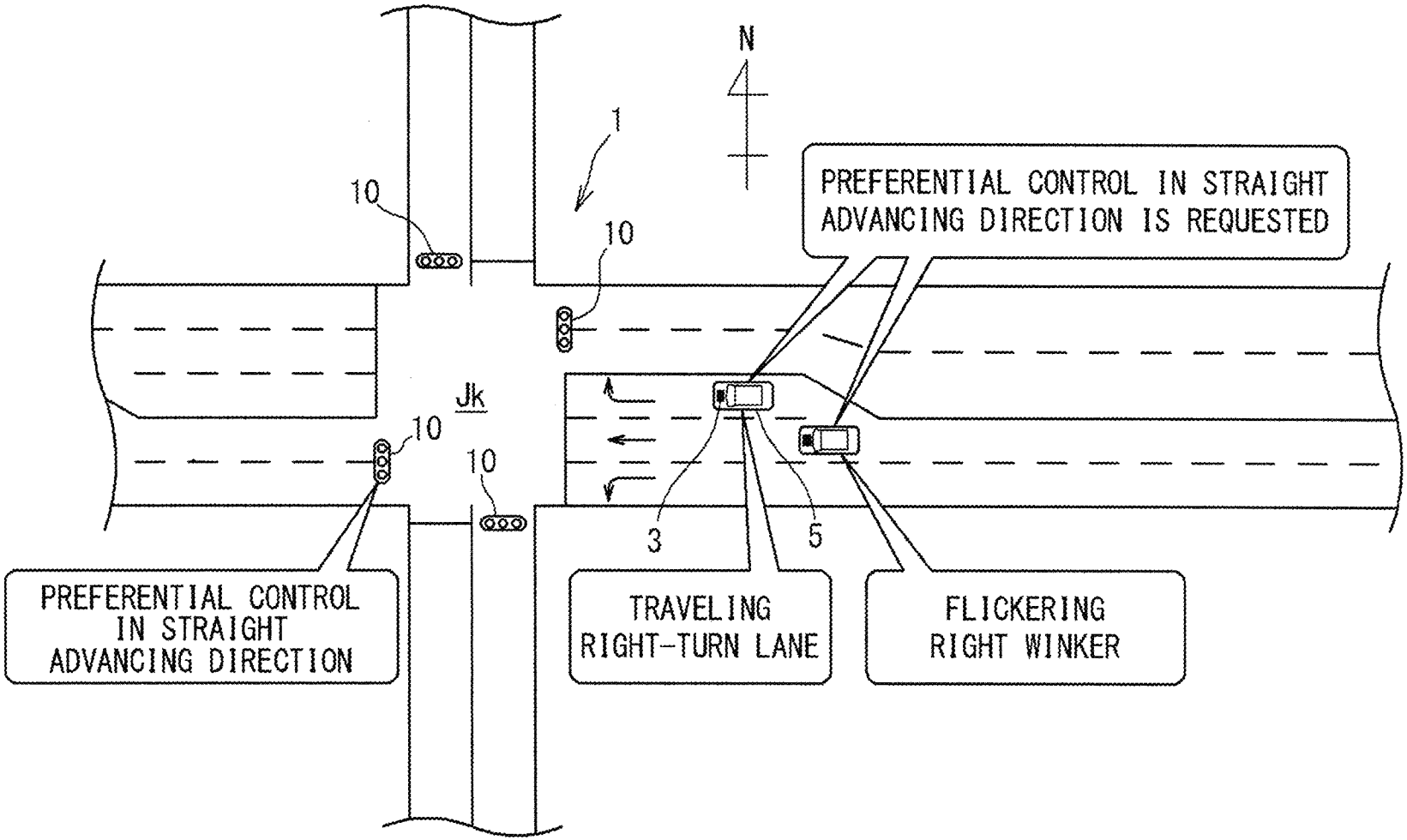
FIG. 15 shows target vehicles that travel upstream of the intersection.

FIG. 15 shows target vehicles traveling upstream of the intersection Jk.

As shown in FIG. 15, when a vehicle 5 as a target vehicle traveling toward the intersection Jk transmits a request of preferential control in the straight advancing direction to the roadside communication device 2 (step S1-2 in FIG. 13), the preferential control unit 21 starts preferential control for the target vehicle.

However, assuming that the vehicle 5 is traveling on a right-turn exclusive lane as shown in FIG. 15, this vehicle 5 is highly likely to advance in the right-turn direction at the intersection Jk. In other words, assuming that the vehicle 5 is traveling a lane other than the straight through lane, this vehicle 5 is less likely to advance in the straight advancing direction through the intersection Jk.

If the vehicle 5 as the target vehicle advances in the right-turn direction at the intersection Jk, a contradiction occurs with respect to the content of preferential control, that is, executing preferential control for a vehicle 5 traveling straight through the intersection Jk.

That is, the preferential control unit 21 executes preferential control for the right-turn vehicle that is not an execution target of the preferential control.

Therefore, when the preferential control cancel unit 22 of the present embodiment determines, based on the position of the target vehicle, that the target vehicle is traveling on a lane other than the straight through lane (step S43) as shown in FIG. 14, the preferential control cancel unit 22 determines that there is a contradiction between the content of the preferential control for the target vehicle and the direction which is obtained based on the position of the target vehicle and in which the target vehicle will advance when passing through the intersection Jk, and causes the preferential control unit 21 to cancel execution of the preferential control for the target vehicle (step S44). As a result, unnecessary execution of preferential control, such as execution of preferential control for a right or left-turn vehicle 5 that is not an execution target of preferential control, can be inhibited.

Upon determining in step S43 that the target vehicle is not traveling on a lane other than the straight through lane, the preferential control cancel unit 22 goes to step S45, and determines whether or not the target vehicle flickers a blinker for right or left turn (step S45). Upon determining that the target vehicle does not flicker the blinker for right or left turn, the preferential control cancel unit 22 returns to step S42. In this case, the preferential control cancel unit 22 determines that the target vehicle travels the straight through lane and will advance in the straight advancing direction through the intersection Jk, and repeats step S42, step S43, and step S45.

Upon determining in step S45 that the target vehicle flickers the blinker for right or left turn, the preferential control cancel unit 22 goes to step S44, and causes the preferential control unit 21 to cancel the preferential control for the target vehicle.

As shown in FIG. 15, if the vehicle 5 as the target vehicle flickers the right blinker while traveling on the straight through lane, this vehicle 5 is highly likely to advance in the right-turn direction at the intersection Jk.

If the vehicle 5 advances in the right-turn direction at the intersection Jk, a contradiction occurs with respect to the content of the preferential control by the preferential control unit 21.

Therefore, in this case, when the preferential control cancel unit 22 determines, based on the position of the target vehicle, that the target vehicle is traveling on the straight through lane and further determines that the blinker for right or left turn is flickered, the preferential control cancel unit 22 determines that there is a contradiction between the content of the preferential control for the target vehicle and the direction in which the target vehicle will advance when passing through the intersection Jk, and causes the preferential control unit 21 to cancel execution of the preferential control for the target vehicle (step S44). As a result, unnecessary execution of preferential control, such as execution of preferential control for a right or left-turn vehicle 5 that is not an execution target of preferential control, can be inhibited.

As described above, in the present embodiment, after the determination unit 22*a* has determined that a vehicle 5 approaching the intersection Jk is a target vehicle as an execution target of preferential control, if a predetermined condition that the preferential control cancel unit 22 determines that there is a contradiction between the content of the preferential control for the target vehicle and the advancing direction, of the target vehicle at the intersection Jk, which is obtained based on the position of the target vehicle, is satisfied, execution of the preferential control by the preferential control unit 21 can be canceled.

In the present embodiment, the direction which is obtained based on the position of the target vehicle and in which the target vehicle will advance when passing through the intersection Jk is compared with the content (extending the green interval for a target vehicle traveling straight in the intersection Jk) of preferential control for the target vehicle, and when there is a contradiction between them, execution of the preferential control is canceled. However, the present disclosure is not limited thereto. For example, as the content of preferential control for a target vehicle, a passage permission direction, which is indicated by a signal phase to be extended or shortened by the preferential control unit 21, may be adopted.

In this case, the preferential control cancel unit 22 compares the direction which is obtained based on the position of the target vehicle and in which the target vehicle will advance when passing through the intersection Jk, with the passage permission direction indicated by the signal phase to be adjusted by the preferential control unit 21, and when there is a contradiction between them, execution of preferential control can be canceled.

In the present embodiment, the preferential control unit 21 regards a vehicle 5 traveling straight through the intersection Jk as an execution target of preferential control. However, a right-turn vehicle and a left-turn vehicle may be set as execution targets of preferential control, or these vehicles may be included in execution targets of preferential control.

In this case, determinations at step S43 and step S45 that are performed by the preferential control cancel unit 22 are set as appropriate according to the direction in which an execution target of preferential control will advance when passing through the intersection Jk.

Third Embodiment

Figure 16:
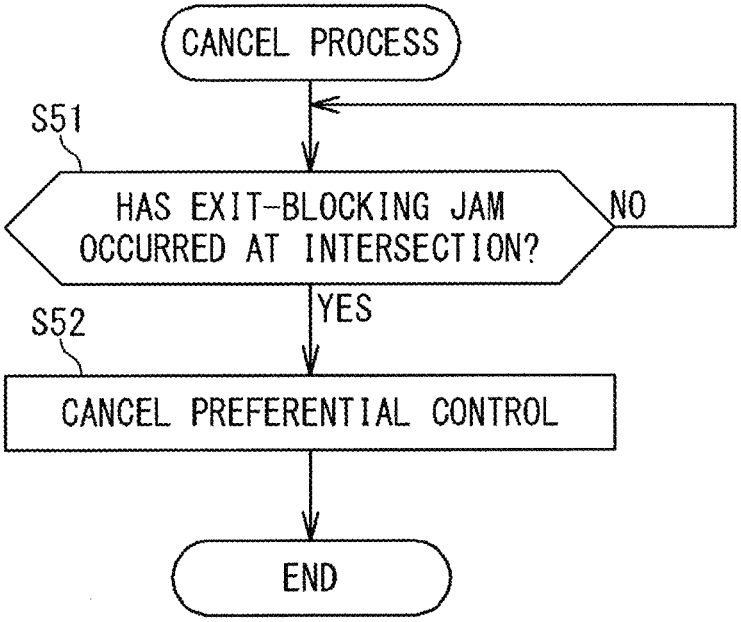
FIG. 16 is a flowchart showing an example of a cancel process according to a third embodiment.

FIG. 16 is a flowchart showing an example of a cancel process according to a third embodiment.

The cancel process of the present embodiment is different from that of the first embodiment in that determination as to whether or not exit-blocking jam has occurred at an intersection Jk is performed without performing determination for presence/absence of a target vehicle for preferential control, and the passing determination process.

First, the preferential control cancel unit 22 determines whether or not exit-blocking jam has occurred on any of outflow roads from the intersection Jk (step S51).

The preferential control cancel unit 22 performs the determination as to whether or not exit-blocking jam has occurred on any of the outflow roads from the intersection Jk, on the basis of probe information, information obtained from the roadside sensor 6, or the like.

If exit-blocking jam has occurred on none of the outflow roads from the intersection Jk, the preferential control cancel unit 22 returns to step S51 again and repeats the determination.

Upon determining that exit-blocking jam has occurred on any of the outflow roads from the intersection Jk, the preferential control cancel unit 22 causes the preferential control unit 21 to cancel execution of preferential control for a vehicle 5 that attempts to enter the outflow road where the exit-blocking jam has occurred (step S52).

When exit-blocking jam has occurred on the outflow road from the intersection Jk, even if preferential control is executed for the vehicle 5, the vehicle 5 might not be able to pass through the intersection Jk.

Therefore, upon determining that exit-blocking jam has occurred on any of the outflow roads from the intersection Jk, the preferential control cancel unit 22 of the present embodiment causes the preferential control unit 21 to cancel execution of the preferential control for the vehicle 5 that attempts to exit the intersection Jk through the outflow road where the exit-blocking jam has occurred (step S52). As a result, unnecessary execution of preferential control, such as execution of preferential control for the vehicle 5 that might not be able to pass through the intersection Jk due to the exit-blocking jam on the outflow road from the intersection Jk, can be inhibited.

In the present embodiment, execution of preferential control for a vehicle 5 that attempts to enter an outflow road where exit-blocking jam has occurred is canceled without specifying a target vehicle for which preferential control has already been started. Therefore, in addition to cancelation of preferential control for a target vehicle that is already being subjected to the preferential control, it is possible to cancel execution of preferential control for a vehicle 5 as a target vehicle of preferential control that is not yet subjected to preferential control but will be subjected to preferential control in the future.

In the present embodiment, after the determination unit 22*a* has determined that a vehicle 5 approaching the intersection Jk is an execution target of preferential control, if a predetermined condition that the preferential control cancel unit 22 determines that exit-blocking jam has occurred on an outflow road from the intersection Jk (outflow road to be subjected to preferential control for the vehicle 5) toward which the vehicle 5 attempts to advance, is satisfied, execution of the preferential control by the preferential control unit 21 can be canceled.

Fourth Embodiment

Figure 17:
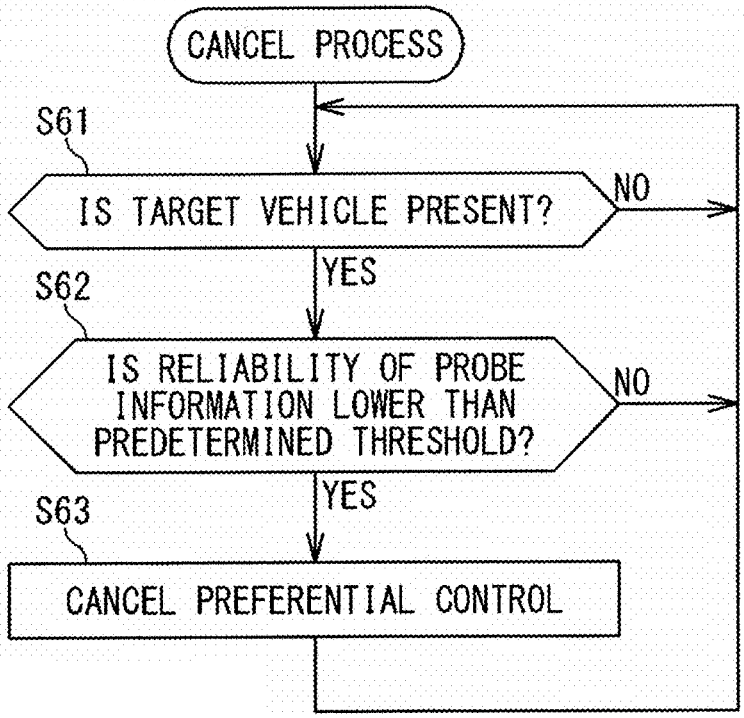
FIG. 17 is a flowchart showing an example of a cancel process according to a fourth embodiment.

FIG. 17 is a flowchart showing an example of a cancel process according to a fourth embodiment.

The cancel process of the present embodiment is different from that of the first embodiment in that determination regarding reliability of probe information is performed instead of the passing determination process.

First, the preferential control cancel unit 22 determines whether or not there is a target vehicle of preferential control (step S61).

Upon determining that there is no target vehicle of preferential control, the preferential control cancel unit 22 repeats step S61 until determining that there is a target vehicle.

Next, the preferential control cancel unit 22 determines whether or not reliability of the probe information of the target vehicle is lower than a predetermined threshold (step S62).

Information indicating reliability of a position in the horizontal direction (position acquisition information), which is stored in a communication packet of vehicle-to-vehicle communication together with the probe information, may be adopted as the reliability of the probe information.

The position acquisition information indicates the reliability of the position in the horizontal direction by a distance, such as 1 m class, 2.5 m class, . . . , 100 m class. The position acquisition information indicates the reliability of position information (probe information) when the value is set so as to be dynamically variable based on the receiving state of a GPS or the like. In the position acquisition information, the reliability of the probe information decreases with an increase in the value of the distance.

The predetermined threshold is set to a value of the position acquisition information at which minimum reliability required as probe information is ensured.

Upon determining that the reliability of the probe information of the target vehicle is equal to or higher than the predetermined threshold, the preferential control cancel unit 22 returns to step S61 again and repeats the determination.

Upon determining that the reliability of the probe information of the target vehicle is lower than the predetermined threshold, the preferential control cancel unit 22 causes the preferential control unit 21 to cancel execution of the preferential control for the target vehicle (step S63).

If the reliability of the probe information of the target vehicle is low, preferential control may not be accurately executed for the target vehicle.

Therefore, upon determining that the reliability of the probe information of the target vehicle is lower than the predetermined threshold, the preferential control cancel unit 22 of the present embodiment causes the preferential control unit 21 to cancel execution of the preferential control for the target vehicle (step S63). As a result, preferential control of low accuracy is inhibited from being unnecessarily executed.

As described above, in the present embodiment, after the determination unit 22*a* has determined that a vehicle 5 approaching the intersection Jk is a target vehicle as an execution target of preferential control, if a predetermined condition that the preferential control unit 21 determines that reliability of the probe information of the target vehicle is lower than the predetermined threshold, is satisfied, execution of the preferential control by the preferential control unit 21 can be canceled.

While the position acquisition information is used as reliability in the present embodiment, error rate, time information, vehicle heading, vehicle speed, etc., may be used as well.

The time information can be used for evaluation of reliability of probe information by being compared to time information of the roadside communication device 2. Regarding the vehicle heading or the vehicle speed, variation thereof with time may be obtained to be used for evaluation of reliability.

[Others]

The embodiment disclosed above is to be considered in all respects as illustrative and not restrictive.

For example, in the above embodiments, the preferential control cancel unit 22 is provided in the processing unit 18 of the roadside communication device 2. However, the present disclosure is not limited thereto. The preferential control cancel unit 22 may be provided in the processing unit 31 of the traffic signal controller 11 or in the central apparatus 4, for example. Likewise, the preferential control unit 21 may be provided in the processing unit 31 of the traffic signal controller 11 or in the central apparatus 4, as well as in the processing unit 18 of the roadside communication device 2. The preferential control unit 21 and the preferential control cancel unit 22 may be provided in separated devices.

The preferential control cancel unit 22 may be provided in a processing unit that includes a computer as a constituent and is independent from the respective devices described above. In this case, this processing unit is mutually communicable with the respective devices described above. The preferential control cancel unit 22 executes the cancel process by mutually exchanging necessary information through communication.

In this case, the processing unit provided with the preferential control cancel unit 22 constitutes a preferential control canceling device.

The preferential control cancel unit 22 may be provided in the processing unit 29 of the on-vehicle communication device 3. In this case, the preferential control cancel unit 22 executes the cancel process regarding preferential control for the vehicle 5 including the preferential control cancel unit 22. In the case where the preferential control cancel unit 22 is provided in the on-vehicle communication device 3, the preferential control cancel unit 22 acquires necessary information from the roadside communication device 2 through roadside-to-vehicle communication.

When cancelling the preferential control for the vehicle 5 by the preferential control unit 21, the preferential control cancel unit 22 provided in the on-vehicle communication device 3 transmits a cancel request for canceling the preferential control to the roadside communication device 2. Upon receiving the cancel request, the preferential control unit 21 of the roadside communication device 2 cancels the preferential control in response to the cancel request.

In the embodiments described above, preferential control is executed based on vehicle detection using probe information and on a preferential control request transmitted from a vehicle 5. This preferential control also includes, for example, recall control that gives right-of-way based on vehicle detection and/or a signal switching request. That is, the preferential control cancel unit 22 of the present embodiment can be used for canceling the right-of-way that is given to a vehicle 5 through the recall control.

The scope of the present invention is defined by the scope of the claims rather than by the meaning described above, and all changes which come within the meaning and range of equivalency of the claims are therefore intended to be embraced therein.

REFERENCE SIGNS LIST

1 traffic signal unit
2 roadside communication device
3 on-vehicle communication device
4 central apparatus
5 vehicle
6 roadside sensor
7 communication line
8 router
10 traffic signal light
11 traffic signal controller
12 signal control line
13 communication line
15 antenna
16 wireless communication unit
17 wired communication unit
18 processing unit
21 preferential control unit
22 preferential control cancel unit
22*a* determination unit
22*b* control unit
27 antenna
28 wireless communication unit
29 processing unit
30 wired communication unit
31 processing unit
40 lay-by
45 road
46 side road
Jk, J1 to J12 intersection

The invention claimed is:

1. A preferential control cancel system having a central processing unit and a storage device, the storage device storing instructions, the instructions, when executed by the central processing unit, configured to perform a method, the method comprising:

determining whether a vehicle approaching an intersection is an execution target of preferential control for preferential passage through the intersection, the preferential control configured to extend a green interval of a traffic signal light at the intersection; and causing, from a start of the preferential control to an end of the extended green interval of the traffic light, execution of the preferential control to be canceled in a case where the vehicle is determined to be the execution target and a predetermined condition is satisfied, wherein the method further includes a process of determining whether the vehicle can pass through the intersection before the end of the extended green intervals based on probe information of the vehicle, and wherein the predetermined condition is that it is determined in the process that the vehicle cannot pass through the intersection before the end of the extended green interval of the traffic light.

2. The preferential control cancel system according to claim 1, wherein the predetermined condition includes that in the process, it is determined based on the probe information of the vehicle that there is a contradiction between content of the preferential control for the vehicle and an advancing direction of the vehicle in the intersection, the advancing direction being based on the probe information of the vehicle.

3. The preferential control cancel system according to claim 1, wherein the predetermined condition includes that in the process, it is determined based on the probe information of the vehicle that reliability of the probe information of the vehicle is lower than a predetermined threshold.

4. The preferential control cancel system according to claim 1, wherein the predetermined condition further includes that in the process, it is determined that the vehicle stopping before the end of the extended green interval of the traffic light.

5. The preferential control cancel system according to claim 1, wherein the predetermined condition further includes that in the process, it is determined that a heading of the vehicle is not directed to the intersection before the end of the extended green interval of the traffic light.

6. A cancel method for cancelling preferential control for preferential passage through an intersection, the preferential control being executed for a vehicle approaching the intersection, the preferential control configured to extend a green interval of a traffic signal light at the intersection, the method comprising:

determining whether the vehicle is an execution target of the preferential control; and causing, from a start of the preferential control to an end of the extended green interval of the traffic light, execution of the preferential control to be canceled in a case where the vehicle is determined to be the execution target and a predetermined condition is satisfied, wherein the method further includes a process of determining whether the vehicle can pass through the intersection before the end of the extended green interval based on probe information of the vehicle, and the predetermined condition is that it is determined in the process that the vehicle cannot pass through the intersection before the end of the extended green interval of the traffic light.

7. A non-transitory computer readable medium having a computer program stored therein, the computer program causing a computer to execute a process of canceling preferential control for preferential passage through an intersection, the preferential control configured to extend a green interval of a traffic signal light at the intersection, the preferential control being executed for a vehicle approaching the intersection, the program causing the computer to execute:

determining whether the vehicle is an execution target of the preferential control; and causing, from a start of the preferential control to an end of the extended green interval of the traffic light, execution of the preferential control to be canceled in a case where the vehicle is determined to be the execution target and a predetermined condition is satisfied wherein the computer further executes a process of determining whether the vehicle can pass through the intersection before the end of the extended green interval based on probe information of the vehicle, and the predetermined condition is that it is determined in the process that the vehicle cannot pass through the intersection before the end of the extended green interval of the traffic light.

* * * * *